US008404414B2

(12) United States Patent
Takaki et al.

(10) Patent No.: US 8,404,414 B2
(45) Date of Patent: Mar. 26, 2013

(54) ELECTROPHOTOGRAPHIC PHOTOCONDUCTOR AND MANUFACTURING METHOD THEREOF

(75) Inventors: Ikuo Takaki, GuangDong (CN); Yoichi Nakamura, Matsumoto (JP); Seizo Kitagawa, Matsumoto (JP); Kazuki Nebashi, Matsumoto (JP); Fengqiang Zhu, Matsumoto (JP)

(73) Assignee: Fuji Electric Co., Ltd., Kawasaki-Shi (JP)

( * ) Notice: Subject to any disclaimer, the term of this patent is extended or adjusted under 35 U.S.C. 154(b) by 237 days.

(21) Appl. No.: 12/990,544

(22) PCT Filed: Apr. 2, 2009

(86) PCT No.: PCT/JP2009/056877

§ 371 (c)(1),
(2), (4) Date: Mar. 18, 2011

(87) PCT Pub. No.: WO2009/133747

PCT Pub. Date: Nov. 5, 2009

(65) Prior Publication Data

US 2011/0189603 A1 Aug. 4, 2011

(30) Foreign Application Priority Data

Apr. 30, 2008 (JP) ..... 2008-119368

(51) Int. Cl.
*G03G 5/04* (2006.01)

(52) U.S. Cl. ..... 430/59.6; 430/58.05; 430/96

(58) Field of Classification Search ..... 430/58.05, 430/59.6, 96

See application file for complete search history.

(56) References Cited

U.S. PATENT DOCUMENTS

| | | | | |
|---|---|---|---|---|
| 3,968,298 | A | 7/1976 | Reinert et al. | |
| 4,390,682 | A | 6/1983 | Kyo et al. | |
| 4,758,491 | A | 7/1988 | Alexandrovich et al. | |
| 4,927,903 | A | 5/1990 | Schreckenberg et al. | |
| 5,162,485 | A | 11/1992 | Odell et al. | |
| 5,780,192 | A * | 7/1998 | O'Regan et al. | 430/59.6 |
| 5,786,119 | A * | 7/1998 | Sorriero et al. | 430/58.3 |
| 2005/0079431 | A1 | 4/2005 | Kobashi et al. | |

FOREIGN PATENT DOCUMENTS

| | | | |
|---|---|---|---|
| DE | 1200319 | B | 9/1965 |
| GB | 890432 | A | 2/1962 |
| JP | 48-28800 | | 9/1973 |
| JP | 55-058223 | A | 4/1980 |
| JP | 60-011441 | A | 1/1985 |
| JP | 61-062040 | A | 3/1986 |
| JP | 64-032267 | | 2/1989 |
| JP | 04-274434 | A | 9/1992 |
| JP | 05-307268 | A | 11/1993 |
| JP | 2000-352834 | A | 12/2000 |
| JP | 2002-023393 | A | 1/2002 |
| JP | 2005-115091 | A | 4/2005 |
| JP | 2005-250503 | A | 9/2005 |
| JP | 2007079554 | * | 3/2007 |
| JP | 2007079555 | * | 3/2007 |

* cited by examiner

*Primary Examiner* — Hoa V Le
(74) *Attorney, Agent, or Firm* — Rabin & Berdo, P.C.

(57) ABSTRACT

Electrophotographic photoconductor including a conductive substrate; and a photosensitive layer provided on the conductive substrate and including at least a charge generation material; a charge transport material; and a resin binder including a copolymer polyarylate resin represented by general formula (I) below:

(I)
(A)
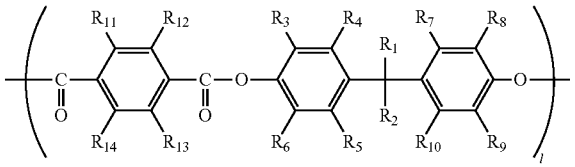
(B)
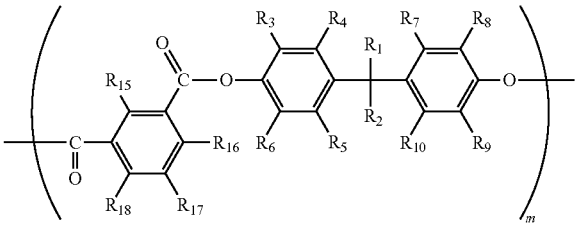
-continued
(C)
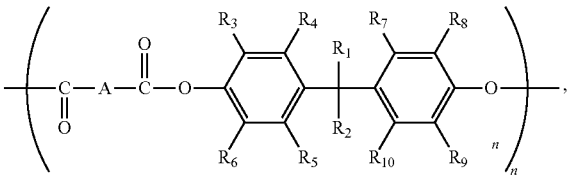
and manufacturing method therefore. Good images with less cracking occurrence are obtained during recycling of a photosensitive drum and peripheral members thereof that includes the electrophotographic photoconductor, and also when a liquid development process is employed.
9 Claims, 1 Drawing Sheet

ELECTROPHOTOGRAPHIC PHOTOCONDUCTOR AND MANUFACTURING METHOD THEREOF

BACKGROUND OF THE INVENTION

1. Field of the Invention

The present invention relates to an electrophotographic photoconductor (hereafter, also simply referred to as "photoconductor") and to a manufacturing method thereof, and more particularly to an electrophotographic photoconductor which comprises mainly a conductive substrate and a photosensitive layer containing an organic material, and is used in electrophotographic printers, copiers, fax machines and the like, and to a manufacturing method of the electrophotographic photoconductor.

2. Background of the Related Art

The basic structure of electrophotographic photoconductors comprises a conductive substrate on which there is disposed a photosensitive layer having photoconductive properties. In recent years, organic electrophotographic photoconductors that use organic compounds as functional components for charge generation and charge transport have been the target of active research and development, and have become ever more widely used in copiers, printers and the like, thanks to their advantageous features, which include material variety, high productivity and stability, among others.

Ordinarily, photoconductors must fulfill the functions of holding surface charge when in the dark, generating charge when receiving light, and transporting the generated charge. Photoconductors include so-called single layer-type photoconductors, which comprise a single-layer photosensitive layer that combines the above functions, and so-called stacked (separate-function) photoconductors that comprise a photosensitive layer in the form of a layer stack in which each layer has a separate function, wherein the layer stack comprises a charge generation layer, that has the function of charge generation upon light reception, and a charge transport layer that has the function of holding surface charge when in the dark and of transporting the charge generated in the charge generation layer upon light reception.

The photosensitive layer is ordinarily formed by coating a conductive substrate with a coating solution in which there are dispersed or dissolved, in an organic solvent, a charge generation material, a charge transport material and a resin binder. Polycarbonate is often used as the resin binder in organic electrophotographic photoconductors, in particular on the outermost surface layer of the photoconductor, thanks to its excellent flexibility, transparency to exposure light, and resistance to friction with paper and toner-scraping blades. Among polycarbonates, bisphenol Z polycarbonates are widely used as the resin binder. Instances of use of polycarbonates as a resin binder are set forth in, for instance, Japanese Patent Application Laid-open No. S61-62040 (Patent Document 1).

Polyarylate resins are also used as the resin binder. West German Patent No. 1200319 (Patent Document 2) sets forth constituent elements such as terephthalic acid, isophthalic acid, succinic acid, adipic acid, sebacic acid and bisphenol, as thermally stabilized dihydroxydiarylalkane materials. Japanese Examined Patent Publication No S48-28800 (Patent Document 3) discloses the feature of using constituent elements such as terephthalic acid, isophthalic acid, adipic acid, sebacic acid, bisphenol A, ethylene glycol or the like, in a method for manufacturing a polyester for easy-sliding films. Japanese Patent Application Laid-open No. S55-58223 (Patent Document 4) discloses constituent elements such as terephthalic acid, isophthalic acid and bisphenol A for enhancing durability against hot and wet thermal aging. Japanese Patent Application Laid-open No. S60-11441 (Patent Document 5) discloses constituent elements such as adipic acid, azelaic acid, sebacic acid, decanedicarboxylic acid, dodecanedicarboxylic acid, phthalic acid, isophthalic acid, terephthalic acid, bisphenol A or the like, in a manufacturing method and a composition for flame-resistant moldings.

In the field of electrophotography, Japanese Patent Application Laid-open No. S64-32267 (Patent Document 6) discloses polybisphenol A-azelate-co-isophthalate as a condensation polymer block in toner compositions. Japanese Patent Application Laid-open No. 2000-352834 (Patent Document 7) discloses a polyester resin that comprises, for instance, terephthalic acid, isophthalic acid, phthalic acid, adipic acid, sebacic acid, azelaic acid or bisphenol A, as a toner image-receiving layer of an electrophotographic image-receiving material for electrophotographic paper or the like. Japanese Patent Application Laid-open No. H4-274434 (Patent Document 8) discloses a bisphenol-based polyester that comprises a bisphenol structure, phthalic acid and an alkylene, as a resin binder for charge transport in a photoconductor, wherein the polyester can be synthesized efficiently, has low melting point viscosity, and has few problematic byproducts. Japanese Patent Application Laid-open No. 2002-23393 (Patent Document 9), the object whereof is to provide an electrophotographic photoconductor having very high light sensitivity and low residual potential, undergoing virtually no residual potential accumulation even after repeated use, exhibiting very low variability as regards charging characteristics and sensitivity, and having excellent stability and durability, discloses a polyester resin that comprises a bisphenol structure, isophthalic acid and terephthalic acid, as a resin binder in a photosensitive layer.

Japanese Patent No. 3953072 (Patent Document 10), the object whereof is to provide an electron photoconductor or the like having excellent solvent cracking resistance and mechanical strength, good anti-electric characteristics, high sensitivity and photomemory, discloses a polyester resin having terephthalic acid, isophthalic acid and alkylene groups as constituent units. Japanese Patent Application Laid-open No. 2005-115091 (Patent Document 11) discloses a polyarylate resin comprising a bisphenol structure, isophthalic acid and terephthalic acid, as a resin binder having high solvent cracking resistance.

However, using a bisphenol Z polycarbonate as a resin binder in an electrophotographic photoconductor was problematic on account solvent cracking and the readiness with which sebum-derived cracks appeared in the photosensitive layer. Solvent cracking is likely to occur due to contact with the solvent of cleaners that are used for cleaning the charging member or the photoconductor. In particular, larger cracks appear on the photosensitive layer when, after cleaning of a contact charging-type charging roller, the solvent does not evaporate completely and remains in contact with the photoconductor.

Recharging and cleaning have become commonplace in photoconductor and cartridges as a response to recycling demands in the wake of growing environmental awareness. Under these circumstances, therefore, it is imperative to solve the problem of solvent cracking. In particular, solvent cracking occurs readily in liquid development processes, since in this case the carrier liquid in which the toner is dispersed comes into direct contact with the photoconductor. A solution to this problem would be thus highly desirable.

To deal with the above problems, Patent Document 1 proposes, for instance, to use a mixture of a bisphenol A polycarbonate resin and a bisphenol Z polycarbonate resin, but this method has proved to be an insufficient solution. The various polyester resins having a bisphenol structure proposed to date have fail to cope sufficiently with the issue of solvent cracking resistance.

It has also been proposed to form a surface protective layer on the photosensitive layer, with a view to, for instance, protecting the photosensitive layer, improving mechanical resistance, and enhancing surface lubricity. However, such surface protective layers as well have failed to avoid the same problem of cracking that bedevils the photosensitive layer.

Under these circumstances, Patent Document 11 discloses a specific polyarylate, as a resin binder, that exhibits unprecedented high solvent cracking resistance. In the current context of ever stronger environmental awareness, however, resin binders for electrophotographic photoconductors should desirably have yet higher solvent cracking resistance.

Thus, it is an object of the present invention to provide an electrophotographic photoconductor and a manufacturing method thereof whereby good images with less cracking occurrence than heretofore can be obtained during recycling of a photosensitive drum and peripheral members thereof, and also in the case of a liquid development process, by improving a resin binder used in a photosensitive layer.

SUMMARY OF THE INVENTION

As a result of research on resin binders having high solvent cracking resistance, the inventors came to focus on polyarylate resins. The inventors found that using a resin binder in the form of a polyarylate resin having a higher ratio of isophthalic acid structure allows achieving excellent solvent cracking resistance and high solubility in solvents for photoconductor coating solutions, and allows increasing the stability of a photoconductor coating solution. The inventors further found out that introducing alkylene groups in the polyarylate resin causes part of the molecule to become more pliable, which makes for a greater degree of freedom in the structure, higher density, and better lubricity, as a result of which there can be realized, an electrophotographic photoconductor having excellent electric characteristics. The inventors perfected the present invention thus on the basis of the above findings.

Specifically, the electrophotographic photoconductor of the present invention is an electrophotographic photoconductor, comprising: a conductive substrate; and a photosensitive layer provided on the conductive substrate and comprised of at least a charge generation material; a charge transport material; and a resin binder comprising a copolymer polyarylate resin represented by general formula (I) below:

(I)

(A)

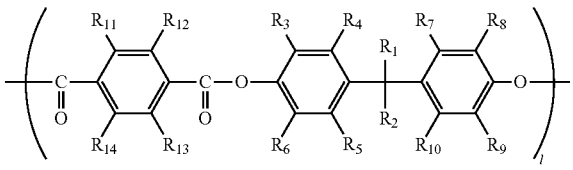

-continued (B)

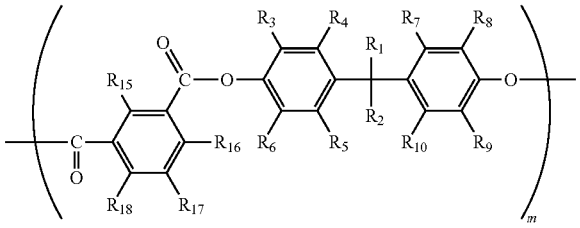

(C)

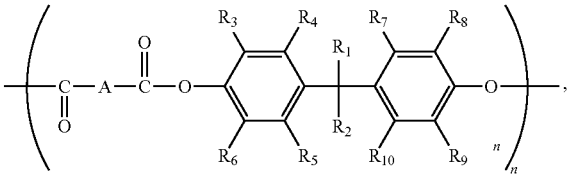

where partial structural formulas (A), (B) and (C) represent structural units that make up the resin binder; l, m and n represent the respective mol % of the structural units (A), (B) and (C) such that l+m+n is 100 mol %, m is 50 to 65 mol % and n is 1 to 10 mol %; $R_1$ and $R_2$ may be identical or different and represent a hydrogen atom, a C1 to C8 alkyl group, a cycloalkyl group or an aryl group, or may form a cyclic structure together with a carbon atom to which these are bonded, and the cyclic structure may have bonded thereto 1 or 2 arylene groups; $R_3$ to $R_{18}$ may be identical or different and represent a hydrogen atom, a C1 to C8 alkyl group, a fluorine atom, a chlorine atom or a bromine atom; and A represents a C4 to C10 divalent alkylene group.

In the photoconductor of the present invention, preferably, the photosensitive layer is of a stacked type structure and includes at least a charge generation layer and at least one charge transport layer that are sequentially stacked, and wherein the charge transport layer comprises said copolymer polyarylate resin represented by general formula (I). Alternatively, the photosensitive layer is of a stacked type structure in which at least a charge transport layer and a charge generation layer are sequentially stacked, and the charge generation layer comprises the copolymer polyarylate resin represented by general formula (I). Alternatively, the photosensitive layer has a single layer-type structure, and the single layer-type photosensitive layer comprises the copolymer polyarylate resin represented by general formula (I). Preferably, $R_1$ and $R_2$ in general formula (I) are both methyl groups, and $R_3$ to $R_{18}$ are hydrogen atoms. The electrophotographic photoconductor of the present invention can be appropriately used in a charging process that uses a contact charging roller. That is, the photosensitive layer has a surface that accepts charge when contacted by a charging mechanism for charging through contact with said surface of the photosensitive layer. The photosensitive layer of the electrophotographic photoconductor is charged and patternwise discharged is use to generate an image, and the electrophotographic photoconductor may be incorporated in an electrophotographic device that comprises a charging mechanism and a discharging mechanism, and optionally at least one of a mechanism for decreasing ozone or nitrogen oxides generated by the charging mechanism or a transfer mechanism. The photoconductor of the present invention, moreover, is particularly effective when used in a developing mechanism for performing development using a liquid developer. That is, the photosensitive layer of the electrophotographic photoconductor is charged and patternwise discharged in use to generate an image, and the image may be developed by a developing mechanism for performing development using a liquid developer.

The method for manufacturing an electrophotographic photoconductor of the present invention is a method for manufacturing an electrophotographic photoconductor, comprising the steps of: providing a conductive substrate; providing a coating solution that comprises a photoconductive material and a resin binder comprised of a copolymer polyarylate resin represented by general formula (I) below:

(I)

(A)

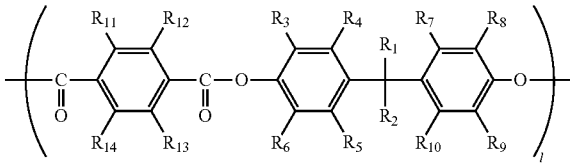

(B)

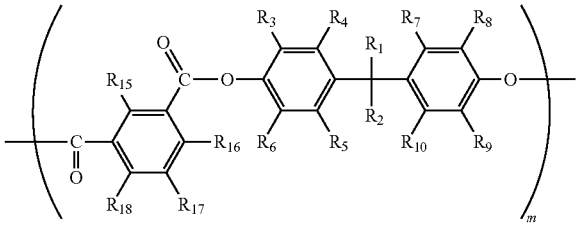

(C)

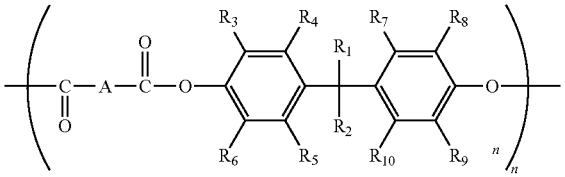

where partial structural formulas (A), (B) and (C) represent structural units that make up the resin binder; l, m and n represent the respective mol % of the structural units (A), (B) and (C) such that l+m+n is 100 mol %, m is 50 to 65 mol % and n is 1 to 10 mol %; $R_1$ and $R_2$ may be identical or different and represent a hydrogen atom, a C1 to C8 alkyl group, a cycloalkyl group or an aryl group, or may form a cyclic structure together with a carbon atom to which these are bonded, and the cyclic structure may have bonded thereto 1 or 2 arylene groups; $R_3$ to $R_{18}$ may be identical or different and represent a hydrogen atom, a C1 to C8 alkyl group, a fluorine atom, a chlorine atom or a bromine atom; and A represents a C4 to C10 divalent alkylene group; and coating the coating solution on the conductive substrate.

Patent Document 11 above indicates that solvent cracking resistance and electric characteristics can be combined by prescribing a specific range for the ratio of terephthalic acid structure and isophthalic acid structure in a copolymer polyarylate resin. The copolymer polyarylate resin set forth in Patent Document 11, however, has no divalent alkylene groups of the above structural unit (C) introduced therein. As a result of diligent research, the inventors have found that the density of a copolymer polyarylate resin having a prescribed range of the ratio of a terephthalic acid structure and an isophthalic acid structure can be increased by further introducing divalent alkylene groups having the above structural unit (C) into the copolymer polyarylate resin, at a predetermined ratio. In turn, this allows enhancing solvent cracking resistance. It has also been found that part of the introduced alkylene groups forms loop structures that, when exposed at the surface, contribute to increasing lubricity.

By using the above copolymer polyarylate resin comprising specific structural units as the resin binder in a photosensitive layer, the present invention allows realizing an electrophotographic photoconductor that yields good images and has improved solvent cracking resistance, while preserving the electrophotographic characteristics of the photoconductor. The invention is particularly effective against cracking when a bisphenol A type is used as the copolymer polyarylate resin.

DETAILED DESCRIPTION OF THE INVENTION

Embodiments of the present invention are explained below with reference to accompanying drawings.

Figure 1A:
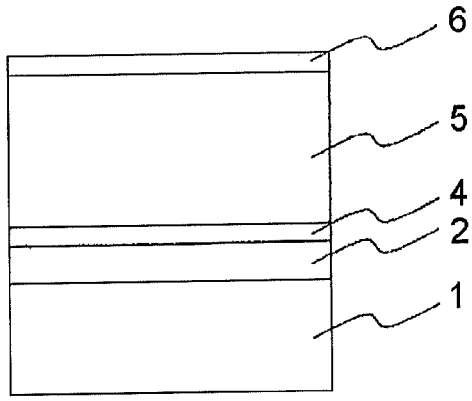
FIG. 1A is a schematic cross-sectional diagram illustrating a negatively-chargeable separate-function stacked electrophotographic photoconductor according to the present invention.
Figure 1B:
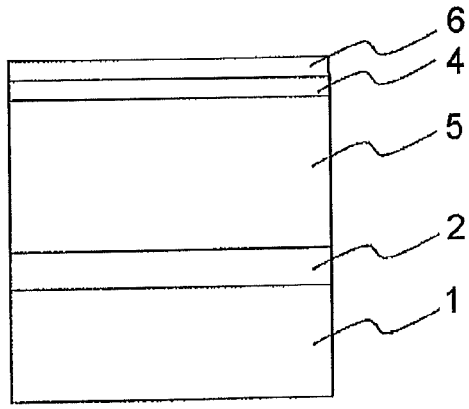
FIG. 1B is a schematic cross-sectional diagram illustrating a positively-chargeable separate-function stacked electrophotographic photoconductor according to the present invention.
Figure 1C:
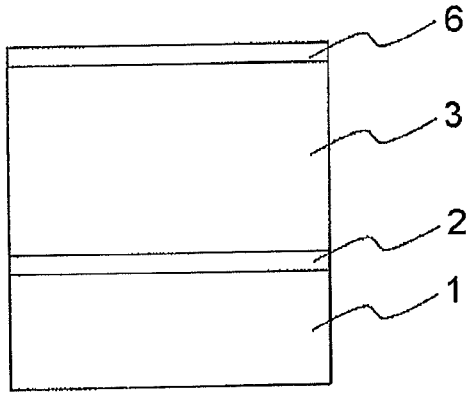
FIG. 1C is a schematic cross-sectional diagram illustrating a positively-chargeable single layer-type electrophotographic photoconductor according to the present invention.

As described above, electrophotographic photoconductors in the form of a stacked (separate-function) photoconductors can be roughly divided into so-called negatively-chargeable stacked photoconductors and positively-chargeable stacked photoconductors, and into single layer-type photoconductors, which are mainly of positively-chargeable type. FIG. 1 is a set of schematic cross-sectional diagrams illustrating electrophotographic photoconductors in examples of the present invention. FIG. 1A illustrates a negatively-chargeable stacked electrophotographic photoconductor, FIG. 1B illustrates a positively-chargeable stacked electrophotographic photoconductor, and FIG. 1C illustrates a positively-chargeable single layer-type electrophotographic photoconductor.

As illustrated in FIG. 1A, a negatively-chargeable stacked photoconductor comprises a conductive substrate 1, and sequentially stacked thereon, an undercoat layer 2, and a photosensitive layer comprising a charge generation layer 4, having a charge generation function, and a charge transport layer 5, having a charge transport function. A positively-chargeable stacked photoconductor, as illustrated in FIG. 1B, comprises a conductive substrate 1, and sequentially stacked thereon, an undercoat layer 2, and a photosensitive layer comprising a charge transport layer 5, having a charge transport function, and a charge generation layer 4, having a charge generation function. A positively-chargeable single layer-type photoconductor, as illustrated in FIG. 1C, comprises a conductive substrate 1, and sequentially stacked thereon, an undercoat layer 2, and a single photosensitive layer 3 that combines charge generation and charge transport functions. In all photoconductor types, the cured undercoat layer 2 may be provided as needed, and a surface protective layer 6 may be further provided on the charge transport layer 5, the charge generation layer 4 or the photosensitive layer 3, as illustrated in the figures. When a surface protective layer 6 is provided, a copolymer polyarylate resin represented by general formula (I) above is contained in the surface protective layer 6.

The conductive substrate 1 functions as one electrode of the photoconductor and, simultaneously, also as a support of the various layers that make up the photoconductor. The conductive substrate 1 may be shaped as a cylinder, a plate, a film or the like, and the material thereof may be a metal such as aluminum, stainless steel or nickel, or glass, resin or the like; the surface whereof has been subjected to a conductive treatment.

The undercoat layer 2 comprises a layer having a resin as a main component, or a metal oxide film comprising alumite or the like, and is provided, as needed, with a view to, for instance, controlling charge injection properties from the conductive substrate 1 to the photosensitive layer 3, covering defects on the surface of the conductive substrate 1, and enhancing adhesiveness between the photosensitive layer 3 and the conductive substrate 1. The resin material used in the undercoat layer 2 may be, for instance, an insulating polymer such as casein, polyvinyl alcohol, polyamide, melamine, cellulose or the like, or a conductive polymer such as polythiophene, polypyrrole or polyaniline. These resins may be used singly or in appropriate combinations. The above resins may be used containing therein a metal oxide such as titanium dioxide, zinc oxide or the like.

The charge generation layer 4 is formed, for instance, by applying a coating solution in which particles of a charge generation material are dispersed in a resin binder. The charge generation layer 4 generates charge upon receiving light. It is important that the charge generation layer 4 should have high charge generation efficiency and, at the same time, that the generated charges can be injected into the charge transport layer 5. Preferably, the charge generation layer 4 exhibits a small electric field dependence, and good injectability even at low electric fields. Examples of the charge generation substance include, for instance, phthalocyanine compounds such as X-form metal-free phthalocyanine, τ-form metal-free phthalocyanine, α-form titanyl phthalocyanine, β-form titanyl phthalocyanine, Y-form titanyl phthalocyanine, γ-form titanyl phthalocyanine, amorphous titanyl phthalocyanine, ϵ-form copper phthalocyanine or the like; as well as azo pigments, anthoanthrone pigments, thiapyrylium pigments, perylene pigments, perynone pigments, squalirium pigments, quinacridone pigments or the like, singly or in appropriate combinations. The substance can be appropriately selected in accordance with the wavelength band of the exposure light source that is used for image formation.

The charge generation layer 4 need only have a charge generation function, and hence the thickness thereof is determined by the light absorption coefficient of the charge generation substance. The thickness is ordinarily no greater than 1 μm, and is preferably no greater than 0.5 μm. The charge generation layer 4 comprises a charge generation material as a main component. To the charge generation material there may be added, for instance, a charge transport material. Examples of the resin binder include, for instance, polycarbonate resin, polyester resins, polyamide resins, polyurethane resins, vinyl chloride resins, vinyl acetate resins, phenoxy resins, polyvinyl acetal resins, polyvinyl butyral resins, polystyrene resins, polysulfone resins, diallyl phthalate resins, and polymers and copolymers of methacrylate resins, which can be used in appropriate combinations.

The charge transport layer 5 comprises mainly the charge transport material and the resin binder. In the present invention, a copolymer polyarylate resin having the structural units represented by the general formula (I) must be used as the resin binder of the charge transport layer 5. The effect envisaged by the present invention can be elicited thereby. In particular, using a bisphenol A copolymer polyarylate resin is more effective in terms of crack prevention. The copolymer polyarylate resin according to general formula (I) may be used singly or in combination with, for instance, various polycarbonate resins, such as bisphenol A types, bisphenol Z types, bisphenol A-biphenyl copolymers, bisphenol Z-biphenyl copolymers or the like; polystyrene resins, polyphenylene resin and the like. The copolymer polyarylate resin defined by formula (I) is preferably used in an amount of 1 wt % to 100 wt %, more preferably 20 wt % to 80 wt %, relative to the resin binder.

Formulas (I-1) to (I-10) illustrate specific examples of the copolymer polyarylate resin having the structural unit represented by general formula (I). The copolymer polyarylate resin according to the present invention, however, is not limited to these illustrative structures.

(I-1)

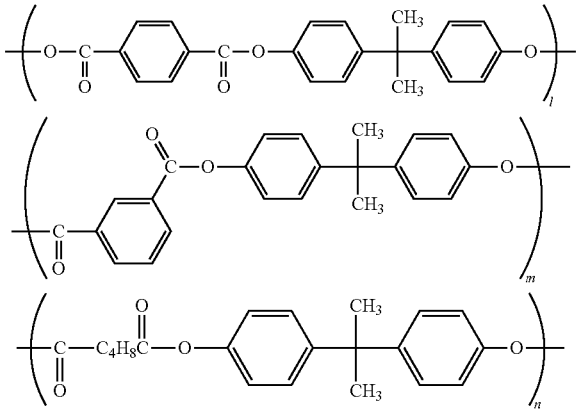

(I-2)

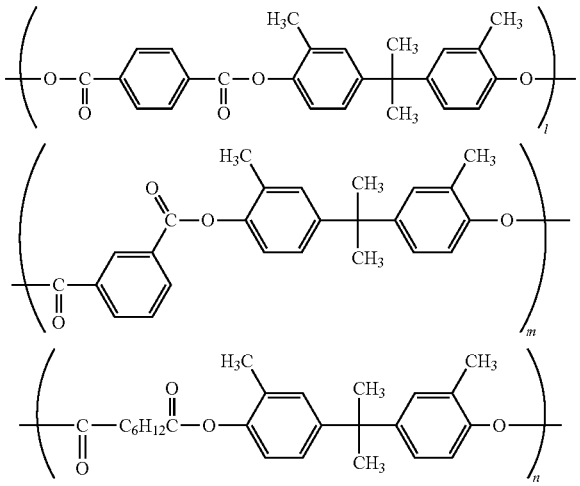

(I-3)

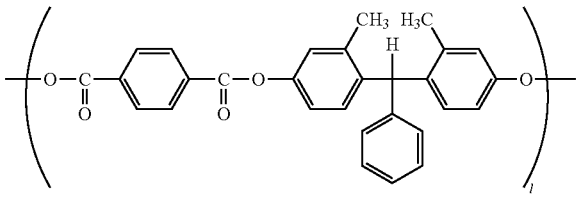

-continued
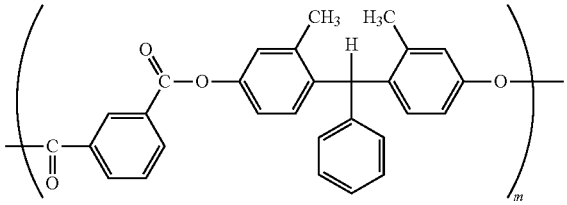
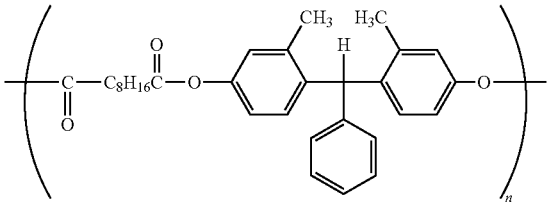
(I-4)
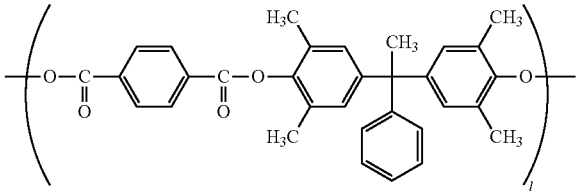
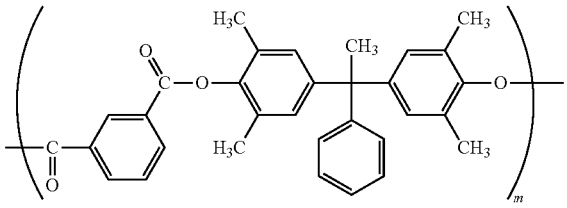
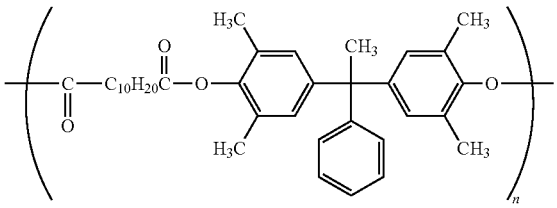
(I-5)
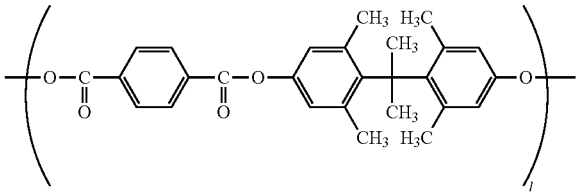
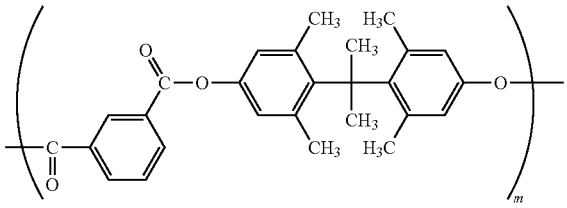
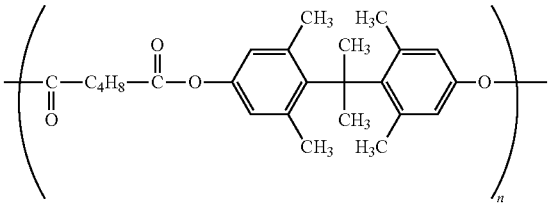
-continued
(I-6)
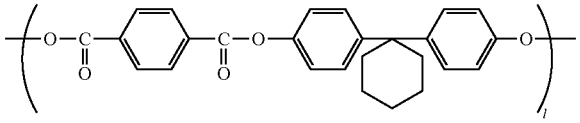
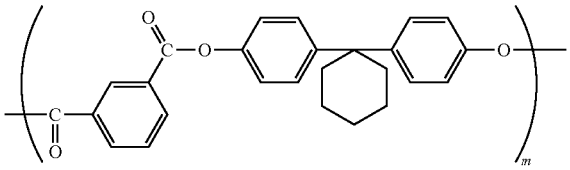
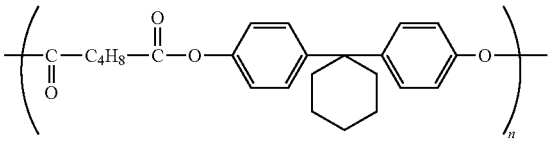
(I-7)
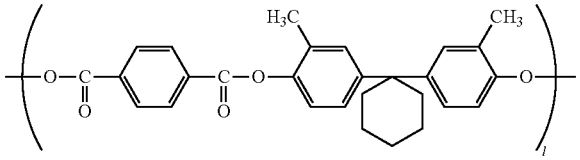
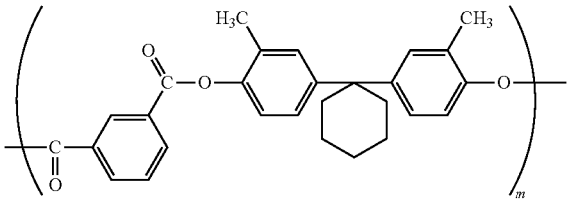
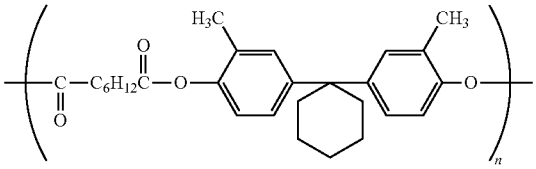
(I-8)
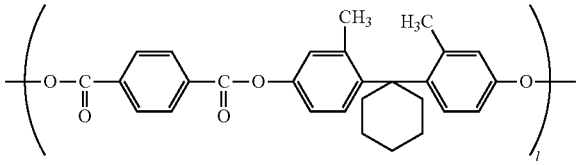
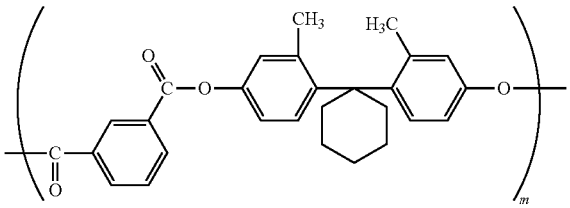
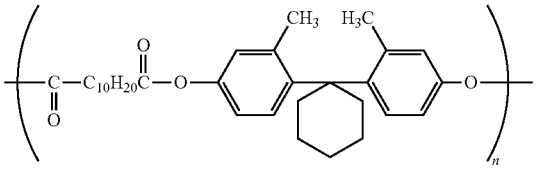

-continued (I-9)

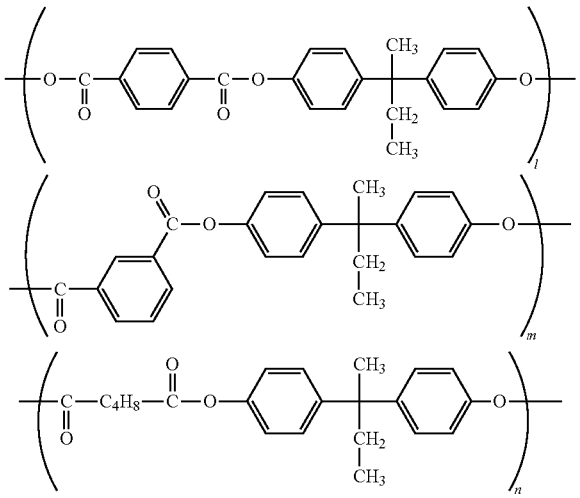

(I-10)

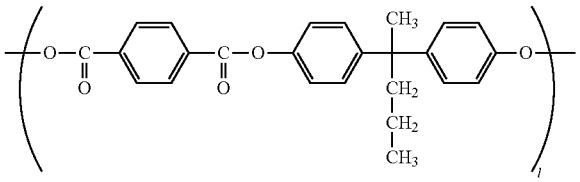

-continued

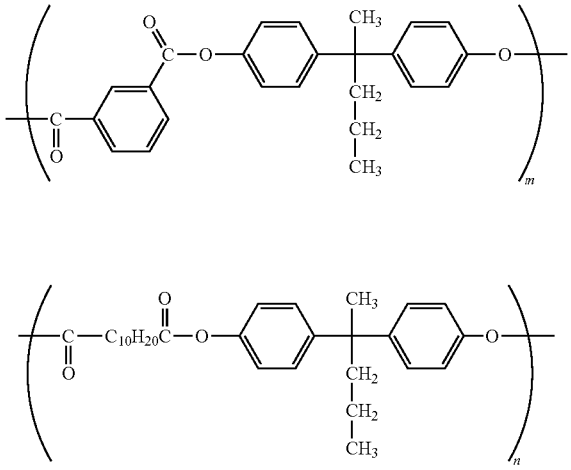

Examples of the charge transport material of the charge transport layer 5 include, for instance, hydrazone compounds, styryl compounds, diamine compounds, butadiene compounds, indole compounds, singly or in appropriate combinations. Although not limited thereto, examples of the charge transport material include, for instance, the compounds (II-1) to (II-13) below.

II-1

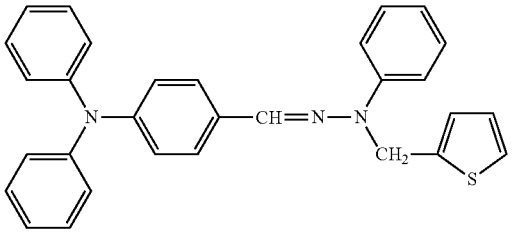

II-2

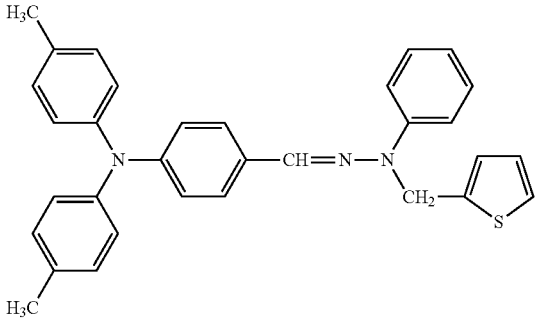

II-3

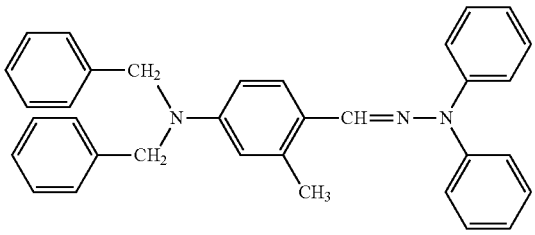

II-4

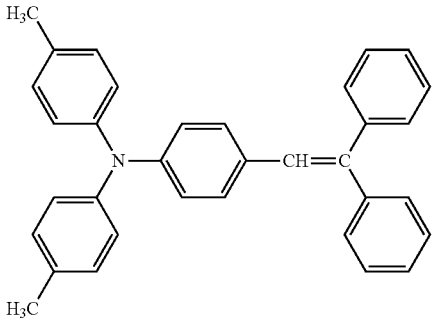

-continued
II-5
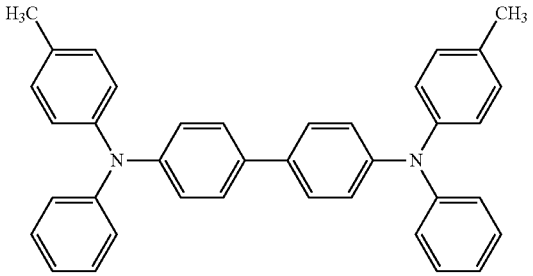
II-6
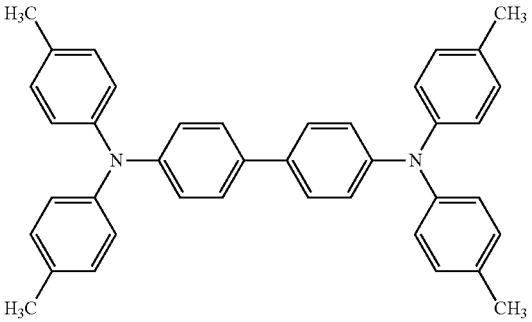
II-7
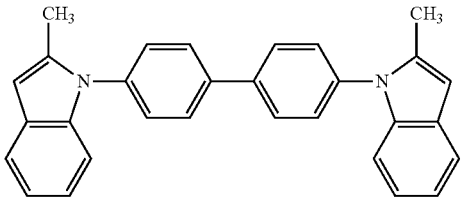
II-8
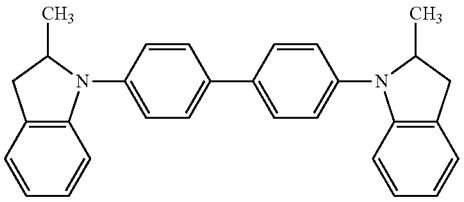
II-9
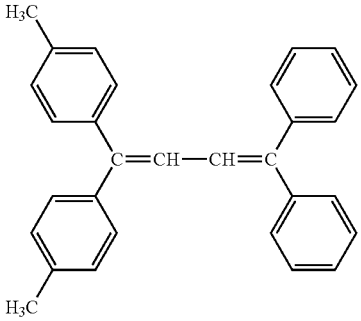
II-10
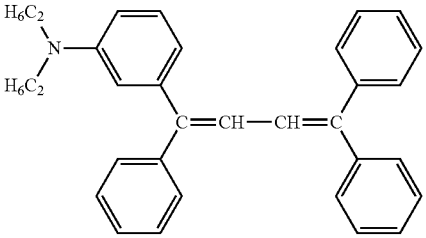
II-11
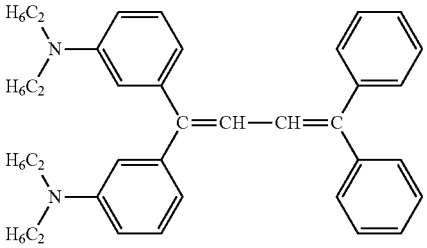
II-12
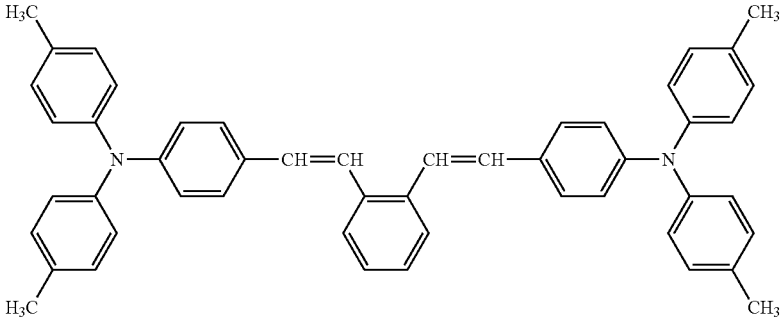

-continued

II-13

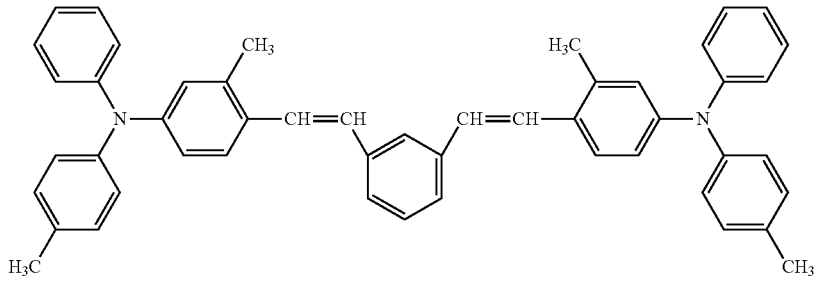

The thickness of the charge transport layer 5 ranges preferably from 3 to 50 μm, more preferably from 15 to 40 μm, in order to maintain an effective surface potential in practice.

The photosensitive layer 3 of single layer-type illustrated in FIG. 1C comprises manly a charge generation material, a hole transport material, an electron transport material (acceptor compound) and a resin binder.

Examples of the charge generation material that can be used include, for instance, phthalocyanine pigments, azo pigments, anthoanthrone pigments, perylene pigments, perynone pigments, polycyclic quinone pigments, squalirium pigments, thiapyrylium pigments, quinacridone pigments or the like. The charge generation material can be used singly or in combinations of two or more. Particularly preferred in the electrophotographic photoconductor of the present invention are azo pigments such as disazo pigments and trisazo pigments; perylene pigments such as N,N'-bis(3,5-dimethylphenyl)-3,4,9,10-perylenebis(carboxyimide); and phthalocyanine pigments such as metal-free phthalocyanine, copper phthalocyanine and titanyl phthalocyanine. Further, significantly improved effects are obtained, in terms of sensitivity, durability and image quality, when using X-form metal-free phthalocyanine, τ-form metal-free phthalocyanine, ϵ-form copper phthalocyanine, α-form titanyl phthalocyanine, β-form titanyl phthalocyanine, Y-form titanyl phthalocyanine, amorphous titanyl phthalocyanine, or the titanyl phthalocyanine described in JP H8-209023 A having a maximum peak at a Bragg angle 2θ of 9.6° in a CuKα:X-ray diffraction spectrum. The content of the charge generation material ranges from 0.1 wt % to 20 wt %, preferably from 0.5 wt % to 10 wt % with respect to solids of the photosensitive layer 3.

Examples of the hole transport material include, for instance, hydrazone compounds, pyrazoline compounds, pyrazolone compounds, oxadiazole compounds, oxazole compounds, arylamine compounds, benzidine compounds, stilbene compounds, styryl compounds, poly-N-vinylcarbazole, polysilane and the like. The hole transport material can be used singly or in combinations of two or more. Preferably, the hole transport material used in the present invention exhibits excellent transport ability of holes generated upon light irradiation, and can be appropriately combined with the charge generation material. The content of hole transport material ranges from 5 wt % to 80 wt %, preferably from 10 wt % to 60 wt %, with respect to solids of the photosensitive layer 3.

As the electron transport material (acceptor compound) there can be used, for instance, succinic anhydride, maleic anhydride, dibromosuccinic anhydride, phthalic anhydride, 3-nitrophthalic anhydride, 4-nitrophthalic anhydride, pyromellitic anhydride, pyromellitic acid, trimellitic acid, trimellitic anhydride, phthalimide, 4-nitrophthalimide, tetracyanoethylene, tetracyanoquinodimethane, chloranil, bromanil, o-nitrobenzoic acid, malononitrile, trinitrofluorenone, trinitrothioxanthone, dinitrobenzene, dinitroanthracene, dinitroacridine, nitroanthraquinone, dinitroanthraquinone, thiopyran compounds, quinone compounds, benzoquinone compounds, diphenoquinone compounds, naphthoquinone compounds, anthraquinone compounds, stilbenequinone compounds, and azoquinone compounds. The electron transport material can be used singly or in combinations of two or more. The content of electron material ranges from 1 wt % to 50 wt %, preferably from 5 wt % to 40 wt %, with respect to solids of the photosensitive layer 3.

Examples of the resin binder of the single layer-type photosensitive layer 3 include, for instance, the copolymer polyarylate resin according to the general formula (I), by itself or suitably combined with a polyester resin, a polyvinyl acetal resin, a polyvinyl butyral resin, a polyvinyl alcohol resin, a vinyl chloride resin, a vinyl acetate resin, a polyethylene resin, a polypropylene resin, an acrylic resin, a polyurethane resin, an epoxy resin, a melamine resin, a silicone resin, a polyamide resin, a polystyrene resin, a polyacetal resin, a polyarylate resin, a polysulfone resin, and polymers of methacrylic acid esters and copolymers thereof. There may also be used mixtures of resins of the same type but dissimilar molecular weight. The content of resin binder ranges from 10 wt % to 90 wt %, preferably from 20 wt % to 80 wt %, with respect to solids of the photosensitive layer 3. The proportion of copolymer polyarylate resin represented by general formula (I) in the resin binder ranges preferably from 1 wt % to 100 wt %, more preferably from 20 wt % to 80 wt %.

The thickness of the photosensitive layer 3 ranges preferably from 3 to 100 μm, more preferably from 10 to 50 μm, in order to preserve effective surface potential in practice.

In both stacked and single layer-type photosensitive layers there can be incorporated a deterioration-preventing agent such as an antioxidant, photostabilizer or the like, with a view to enhancing environment resistance and stability to harmful light. Compounds used for this purpose include, for instance, chromanol derivatives and esterified products thereof such as tocopherol, polyarylalkane compounds, hydroquinone derivatives, ether compounds, diether compounds, benzophenone derivatives, benzotriazole derivatives, thioether compounds, phenylenediamine derivatives, phosphonic acid esters, phosphorous acid esters, phenol compounds, hindered phenol compounds, linear amine compounds, cyclic amine compounds, and hindered amine compounds.

Leveling agents such as silicone oil or fluorine-containing oil can be further incorporated into the photosensitive layer, with a view to improving leveling characteristics and providing lubricity in the formed film. With a view to, for instance, reducing the coefficient of friction and imparting lubricity, there may also be added microparticles of metal compounds including metal oxides such as silicon oxide (silica), titanium oxide, zinc oxide, calcium oxide, aluminum oxide (alumina) or zirconium oxide; metal sulfates such as barium sulfate or calcium sulfate; or metal nitride such as silicon nitride or aluminum nitride; or fluororesin particles such as tetrafluoroethylene resin; or fluorine-containing comb-type graft polymerization resins. Other known additives can be added as needed, so long as electrophotographic characteristics are not substantially impaired thereby.

EXAMPLES

Specific embodiments of the present invention are explained below based on examples. Unless departing from the scope thereof, however, the present invention is not limited to the examples below.

Manufacture of a Copolymer Polyarylate Resin

Manufacturing Example 1

Method for Manufacturing a Copolymer Polyarylate Resin (III-1)

A 5-liter 4-necked flask was charged with 300 mL of deionized water, 1.24 g of NaOH, 0.459 g of p-tert-butyl phenol, 30.3 g of bisphenol A, and 0.272 g of tetrabutylammonium bromide. Further, 9.261 g of terephthalic acid chloride, 17.704 g of isophthalic acid chloride and 0.246 g of adipic acid chloride were dissolved in 300 mL of methylene chloride. The resulting solution was added over 2 minutes, and the reaction was left to proceed for 1.5 hours under stirring. Once the reaction was over, further 200 mL of methylene chloride were added for dilution. The aqueous phase was separated and was re-precipitated in four times the volume thereof of methanol. After drying at 60° C. for 2 hours, the obtained crude product was dissolved in methylene chloride to a 5% solution, and the resulting solution was washed with deionized water. The reaction liquid was re-precipitated by dripping while under vigorous stirring in 5 volumes of acetone. The resulting precipitate was filtered off and was dried at 60° C. for 2 hours, to yield 22.5 g of the target polymer (yield 47.1%). The weight-average molecular weight Mw of the copolymer polyarylate resin (III-1) was 68,500 in terms of polystyrene equivalent. The structural formula of the copolymer polyarylate resin (III-1) was as follows.

(III-1)

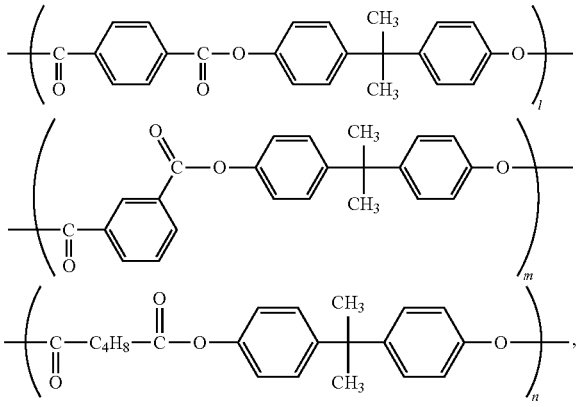

where l:m:n=34:65:1 (molar ratio).

Manufacturing Example 2

Method for Manufacturing a Copolymer Polyarylate Resin (III-2)

The example was identical to Manufacturing example 1, except that herein the addition amount of terephthalic acid chloride was 13.346 g, and the addition amount of isophthalic acid chloride was 13.619 g. The polystyrene average molecular weight Mw of the obtained copolymer polyarylate resin (III-2) (23.2 g, yield 48.5%) was 70,200. The structural formula of the copolymer polyarylate resin (III-2) was as follows.

(III-2)

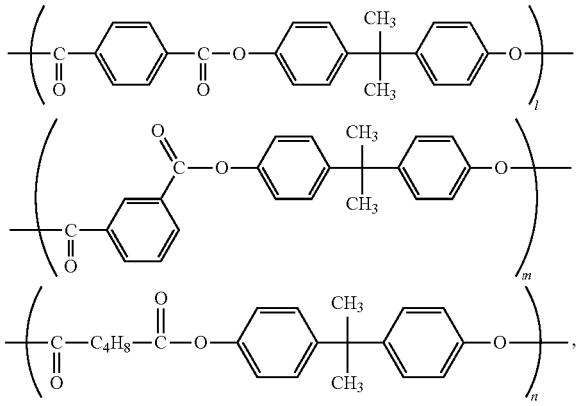

where l:m:n=49:50:1 (molar ratio).

Manufacturing Example 3

Method for Manufacturing a Copolymer Polyarylate Resin (III-3)

The example was identical to Manufacturing example 1, except that herein the addition amount of terephthalic acid chloride was 12.802 g, the addition amount of isophthalic acid chloride was 13.619 g, and the addition amount of adipic acid chloride was 0.737 g. The polystyrene average molecular weight Mw of the obtained copolymer polyarylate resin (III-3) (23.5 g, yield 49.2%) was 72,300. The structural formula of the copolymer polyarylate resin (III-3) was as follows.

(III-3)

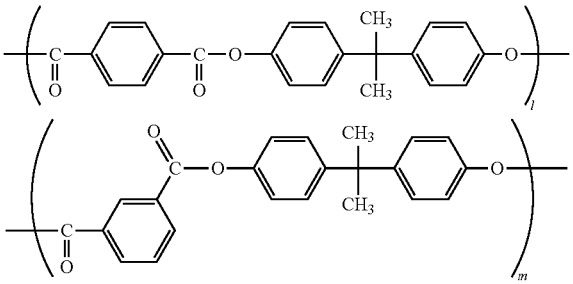

-continued

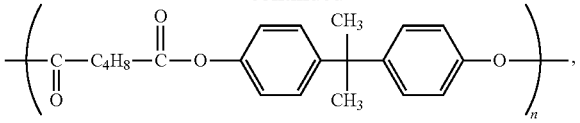

where l:m:n=47:50:3 (molar ratio).

Manufacturing Example 4

Method for Manufacturing a Copolymer Polyarylate Resin (III-4)

The example was identical to Manufacturing example 1, except that herein the addition amount of terephthalic acid chloride was 11.985 g, the addition amount of isophthalic acid chloride was 13.619 g, and the addition amount of adipic acid chloride was 1.473 g. The polystyrene average molecular weight Mw of the obtained copolymer polyarylate resin (III-4) (24.3 g, yield 51.0%) was 69,000. The structural formula of the copolymer polyarylate resin (III-4) was as follows.

(III-4)

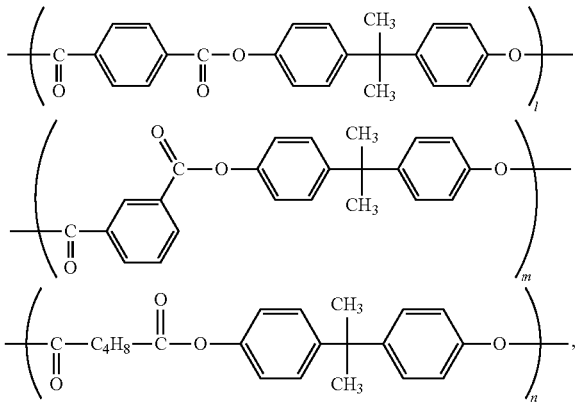

where l:m:n=44:50:6 (molar ratio).

Manufacturing Example 5

Method for Manufacturing a Copolymer Polyarylate Resin (III-5)

The example was identical to Manufacturing example 1, except that herein the addition amount of terephthalic acid chloride was 10.895 g, the addition amount of isophthalic acid chloride was 13.619 g, and the addition amount of adipic acid chloride was 2.456 g. The polystyrene average molecular weight Mw of the obtained copolymer polyarylate resin (III-5) (24.5 g, yield 51.0%) was 72,700. The structural formula of the copolymer polyarylate resin (III-5) was as follows.

(II-5)

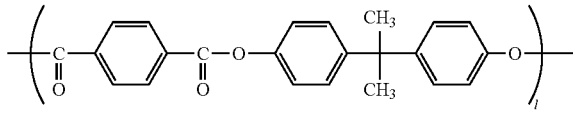

-continued

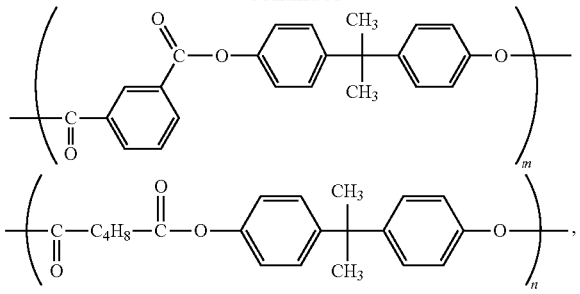

where l:m:n=40:50:10 (molar ratio).

Manufacturing Example 6

Method for Manufacturing a Copolymer Polyarylate Resin (III-6)

The example was identical to Manufacturing example 1, except that herein 35.6 g of 4,4'-cyclohexylidene bisphenol were used as the bisphenol A, the addition amount of terephthalic acid chloride was 12.802 g, the addition amount of isophthalic acid chloride was 13.619 g, and the addition amount of adipic acid chloride was 0.737 g. The polystyrene average molecular weight Mw of the obtained copolymer polyarylate resin (III-6) (28.0 g, yield 58.6%) was 72,700. The structural formula of the copolymer polyarylate resin (III-6) was as follows.

(III-6)

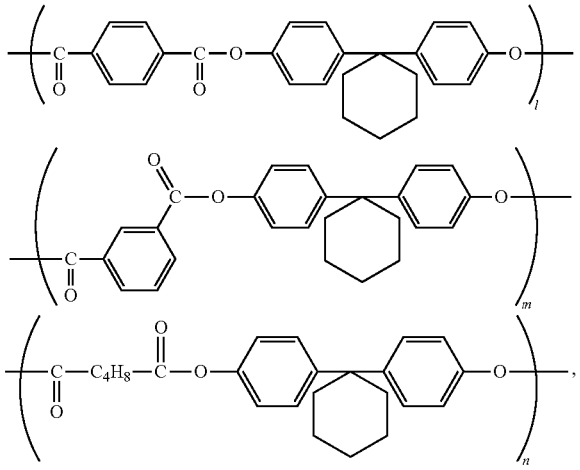

where l:m:n=47:50:3 (molar ratio).

Manufacturing Example 7

Method for Manufacturing a Copolymer Polyarylate Resin (III-7)

The example was identical to Manufacturing example 1, except that herein 34.0 g of 4,4'-isopropylidene-bis-(2-methyl phenol) were used as the bisphenol A, the addition amount of terephthalic acid chloride was 12.802 g, the addition amount of isophthalic acid chloride was 13.619 g, and the addition amount of adipic acid chloride was 0.737 g. The polystyrene average molecular weight Mw of the obtained copolymer polyarylate resin (III-7) (22.0 g, yield 46.2%) was 72,200. The structural formula of the copolymer polyarylate resin (III-7) was as follows.

(III-7)

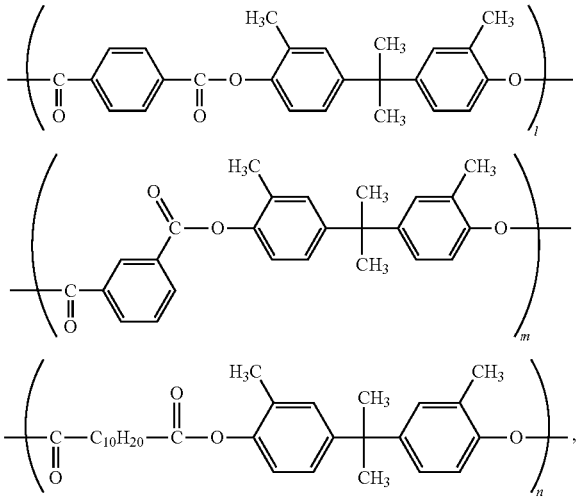

where l:m:n=47:50:3 (molar ratio).

Manufacturing Example 8

Method for Manufacturing a Copolymer Polyarylate Resin (III-8)

The example was identical to Manufacturing example 1, except that herein the addition amount of terephthalic acid chloride was 6.537 g, the addition amount of isophthalic acid chloride was 20.428 g, and the addition amount of adipic acid chloride was 0.246 g. The polystyrene average molecular weight Mw of the obtained copolymer polyarylate resin (III-8) (23.0 g, yield 48.1%) was 74,000. The structural formula of the copolymer polyarylate resin (III-8) was as follows.

(III-8)

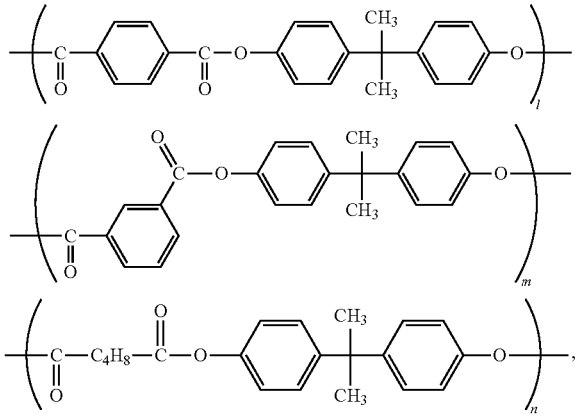

where l:m:n=24:75:1 (molar ratio).

Manufacturing Example 9

Method for Manufacturing a Copolymer Polyarylate Resin (III-9)

The example was identical to Manufacturing example 1, except that herein the addition amount of terephthalic acid chloride was 7.899 g, the addition amount of isophthalic acid chloride was 19.066 g, and the addition amount of adipic acid chloride was 0.246 g. The polystyrene average molecular weight Mw of the obtained copolymer polyarylate resin (III-9) (22.1 g, yield 46.2%) was 69,900. The structural formula of the copolymer polyarylate resin (III-9) was as follows.

(III-9)

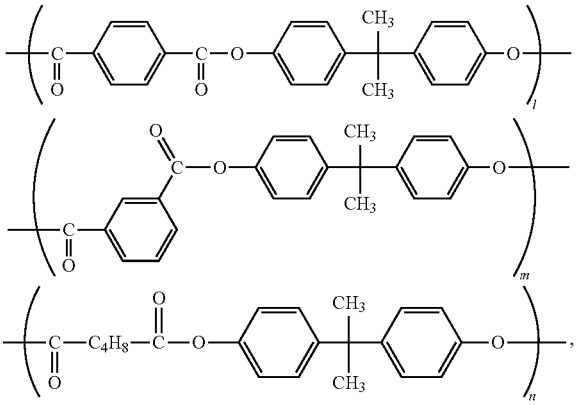

where l:m:n=29:70:1 (molar ratio).

Manufacturing Example 10

Method for Manufacturing a Copolymer Polyarylate Resin (III-10)

The example was identical to Manufacturing example 1, except that herein the addition amount of terephthalic acid chloride was 16.070 g, the addition amount of isophthalic acid chloride was 10.895 g, and the addition amount of adipic acid chloride was 0.246 g. The polystyrene average molecular weight Mw of the obtained copolymer polyarylate resin (III-10) (23.9 g, yield 50.0%) was 68,200. The structural formula of the copolymer polyarylate resin (III-10) was as follows.

(III-10)

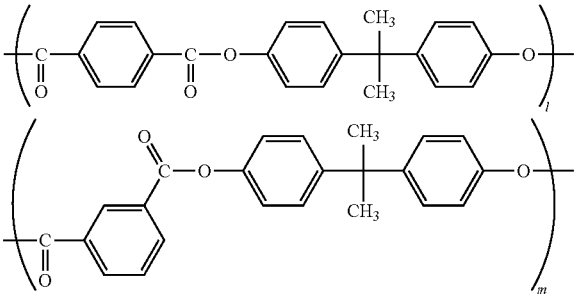

-continued

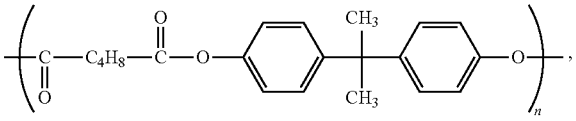

where l:m:n=59:40:1 (molar ratio).

Manufacturing Example 11

Method for Manufacturing a Copolymer Polyarylate Resin (III-11)

The example was identical to Manufacturing example 1, except that herein the addition amount of terephthalic acid chloride was 18.794 g, the addition amount of isophthalic acid chloride was 8.171 g, and the addition amount of adipic acid chloride was 0.246 g. The polystyrene average molecular weight Mw of the obtained copolymer polyarylate resin (III-11) (23.0 g, yield 48.1%) was 69,800. The structural formula of the copolymer polyarylate resin (III-11) was as follows.

(III-11)

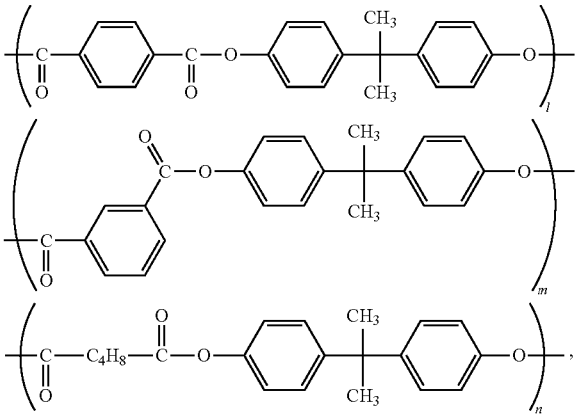

where l:m:n=69:30:1 (molar ratio).

Manufacturing Example 12

Method for Manufacturing a Copolymer Polyarylate Resin (III-12)

The example was identical to Manufacturing example 1, except that herein the addition amount of terephthalic acid chloride was 13.483 g, the addition amount of isophthalic acid chloride was 13.619 g, and the addition amount of adipic acid chloride was 0.123 g. The polystyrene average molecular weight Mw of the obtained copolymer polyarylate resin (III-12) (21.9 g, yield 45.8%) was 72,200. The structural formula of the copolymer polyarylate resin (III-12) was as follows.

(III-12)

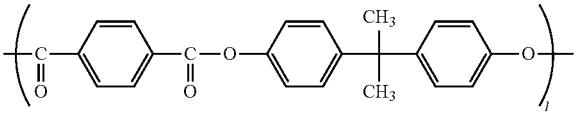

-continued

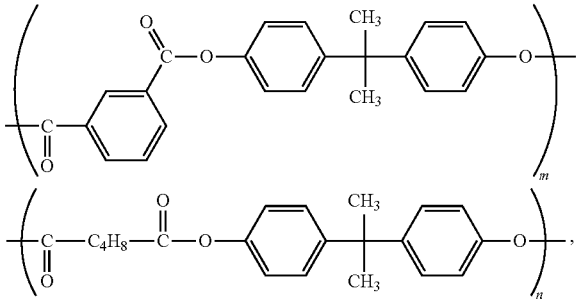

where l:m:n=49.5:50:0.5 (molar ratio).

Manufacturing Example 13

Method for Manufacturing a Copolymer Polyarylate Resin (III-13)

The example was identical to Manufacturing example 1, except that herein the addition amount of terephthalic acid chloride was 10.623 g, the addition amount of isophthalic acid chloride was 13.619 g, and the addition amount of adipic acid chloride was 2.701 g. The polystyrene average molecular weight Mw of the obtained copolymer polyarylate resin (III-13) (23.6 g, yield 49.6%) was 73,900. The structural formula of the copolymer polyarylate resin (III-13) was as follows.

(III-13)

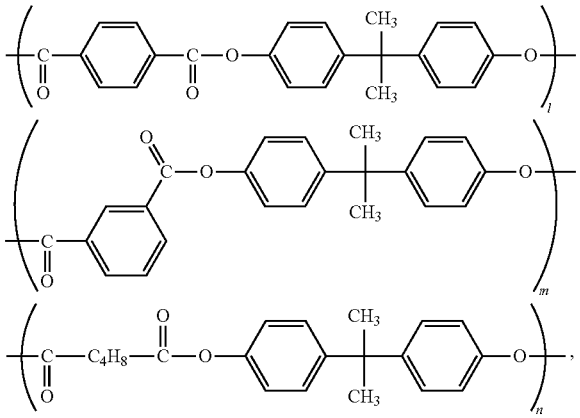

where l:m:n=39:50:11 (molar ratio).

Manufacturing Example 14

Method for Manufacturing a Copolymer Polyarylate Resin (III-14)

The example was identical to Manufacturing example 1, except that herein the addition amount of terephthalic acid chloride was 9.533 g, the addition amount of isophthalic acid chloride was 13.619 g, and the addition amount of adipic acid chloride was 3.683 g. The polystyrene average molecular weight Mw of the obtained copolymer polyarylate resin (III-14) (24.1 g, yield 50.8%) was 71,000. The structural formula of the copolymer polyarylate resin (III-14) was as follows.

(III-14)

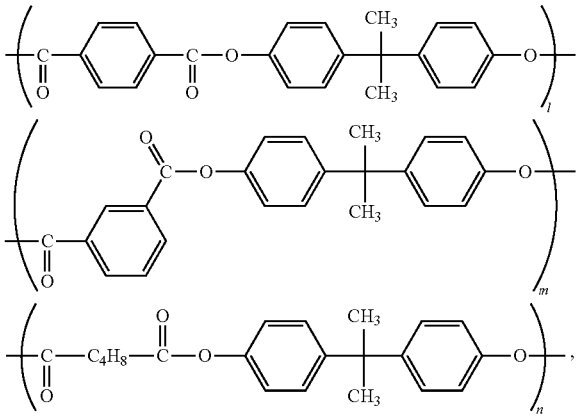

where l:m:n=35:50:15 (molar ratio).

Manufacturing Example 15

Method for Manufacturing a Copolymer Polyarylate Resin (III-15)

The example was identical to Manufacturing example 1, except that herein the addition amount of terephthalic acid chloride was 8.035 g, the addition amount of isophthalic acid chloride was 19.066 g, and the addition amount of adipic acid chloride was 0.123 g. The polystyrene average molecular weight Mw of the obtained copolymer polyarylate resin (III-15) (23.7 g, yield 49.6%) was 71,100. The structural formula of the copolymer polyarylate resin (III-15) was as follows.

(III-15)

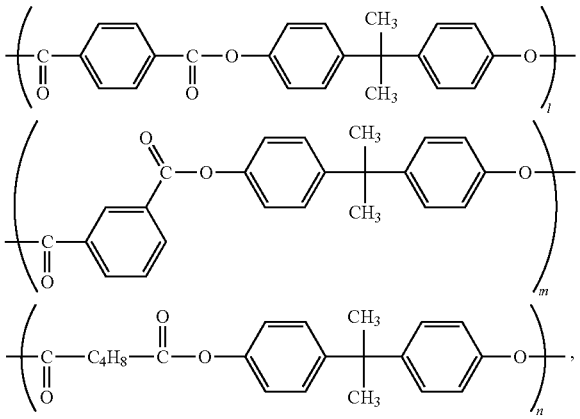

where l:m:n=29.5:70:0.5 (molar ratio).

Manufacturing Example 16

Method for Manufacturing a Copolymer Polyarylate Resin (III-16)

The example was identical to Manufacturing example 1, except that herein the addition amount of terephthalic acid chloride was 13.483 g, the addition amount of isophthalic acid chloride was 13.619 g, and the addition amount of adipic acid chloride was 0.123 g. The polystyrene average molecular weight Mw of the obtained copolymer polyarylate resin (III-16) (24.5 g, yield 51.2%) was 73,000. The structural formula of the copolymer polyarylate resin (III-16) was as follows.

(III-16)

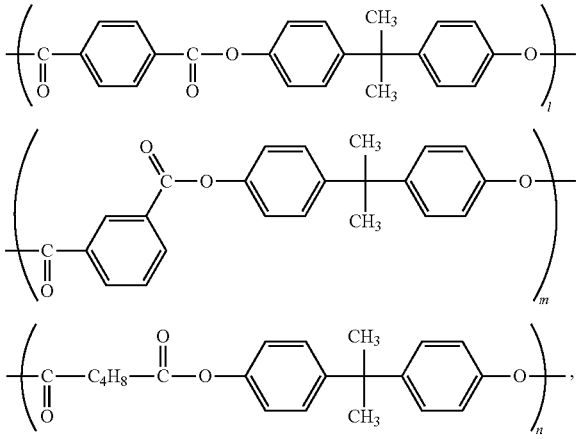

where l:m:n=49.5:50:0.5 (molar ratio).

Manufacturing Example 17

Method for Manufacturing a Copolymer Polyarylate Resin (III-17)

The example was identical to Manufacturing example 1, except that herein the addition amount of terephthalic acid chloride was 5.175 g, the addition amount of isophthalic acid chloride was 19.066 g, and the addition amount of adipic acid chloride was 2.701 g. The polystyrene average molecular weight Mw of the obtained copolymer polyarylate resin (III-17) (22.6 g, yield 47.5%) was 72,800. The structural formula of the copolymer polyarylate resin (III-17) was as follows.

(III-17)

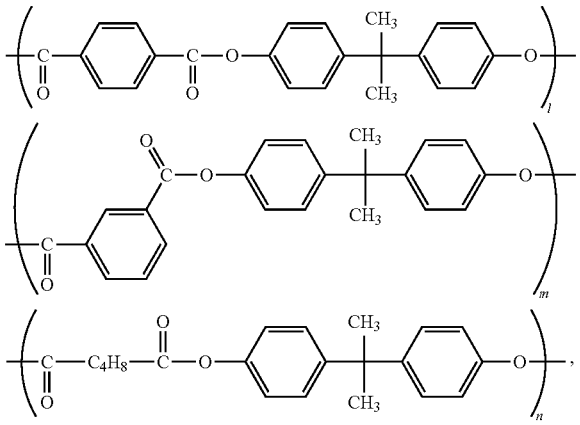

where l:m:n=19:70:11 (molar ratio).

Manufacturing Example 18

Method for Manufacturing a Copolymer Polyarylate Resin (III-18)

The example was identical to Manufacturing example 1, except that herein the addition amount of terephthalic acid chloride was 13.346 g, the addition amount of isophthalic acid chloride was 10.895 g, and the addition amount of adipic acid chloride was 2.701 g. The polystyrene average molecular weight Mw of the obtained copolymer polyarylate resin (III-18) (24.3 g, yield 51.1%) was 71,000. The structural formula of the copolymer polyarylate resin (III-18) was as follows.

(III-18)

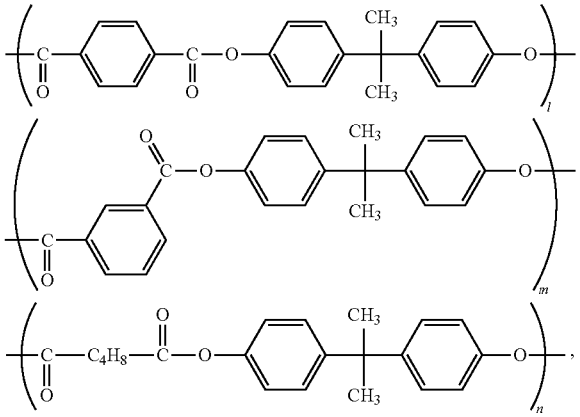

where l:m:n=49:40:11 (molar ratio).

Manufacturing Example 19

Method for Manufacturing a Copolymer Polyarylate Resin (III-19)

The example was identical to Manufacturing example 1, except that herein the addition amount of terephthalic acid chloride was 12.802 g, the addition amount of isophthalic acid chloride was 13.619 g, and 0.850 g of suberic acid chloride were added instead of adipic acid chloride. The polystyrene average molecular weight Mw of the obtained copolymer polyarylate resin (III-19) (23.5 g, yield 49.2%) was 72,400. The structural formula of the copolymer polyarylate resin (III-19) was as follows.

(III-19)

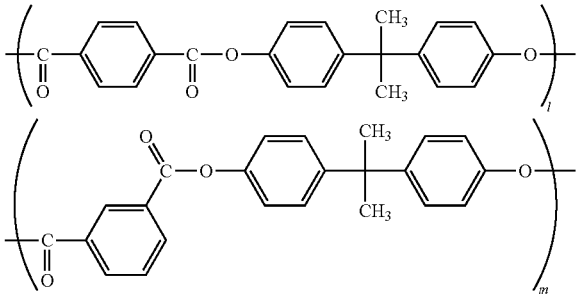

-continued

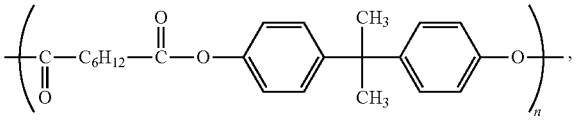

where l:m:n=47:50:3 (molar ratio).

Manufacturing Example 20

Method for Manufacturing a Copolymer Polyarylate Resin (III-20)

The example was identical to Manufacturing example 1, except that herein 37.8 g of 4,4'-isopropylidene-bis-(2,6-dimethyl phenol) were used as the bisphenol A, the addition amount of terephthalic acid chloride was 12.802 g, the addition amount of isophthalic acid chloride was 13.619 g, and 0.850 g of suberic acid chloride were added instead of adipic acid chloride. The polystyrene average molecular weight Mw of the obtained copolymer polyarylate resin (III-20) (27.9 g, yield 58.6%) was 73,000. The structural formula of the copolymer polyarylate resin (III-20) was as follows.

(III-20)

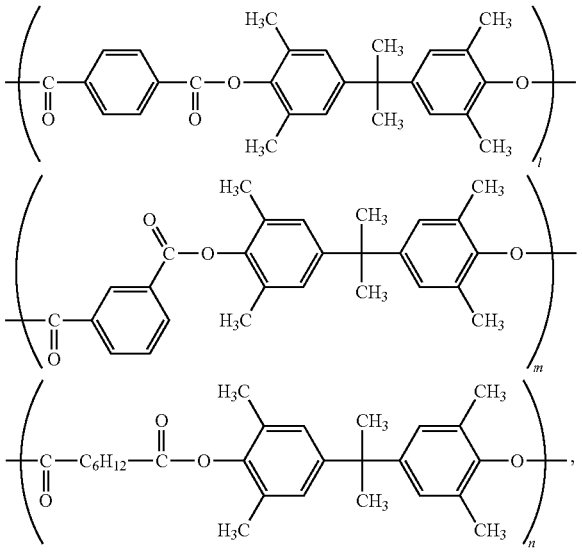

where l:m:n=47:50:3 (molar ratio).

Manufacturing Example 21

Method for Manufacturing a Copolymer Polyarylate Resin (III-21)

The example was identical to Manufacturing example 1, except that herein the addition amount of terephthalic acid chloride was 12.802 g, the addition amount of isophthalic acid chloride was 13.619 g, and 0.963 g of sebacic acid chloride were added instead of adipic acid chloride. The polystyrene average molecular weight Mw of the obtained copolymer polyarylate resin (III-21) (22.9 g, yield 47.4%) was 71,100. The structural formula of the copolymer polyarylate resin (III-21) was as follows.

(III-21)

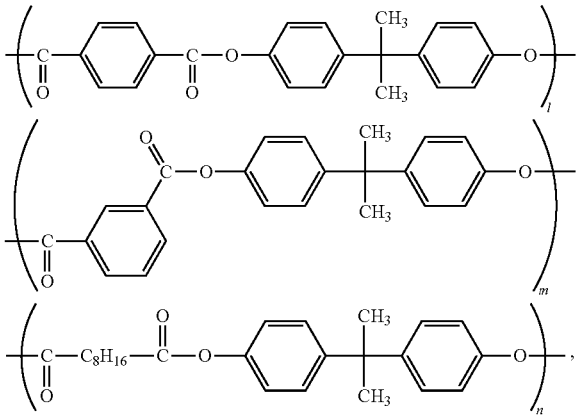

where l:m:n=47:50:3 (molar ratio).

Manufacturing Example 22

Method for Manufacturing a Copolymer Polyarylate Resin (III-22)

The example was identical to Manufacturing example 1, except that herein 36.7 g of 4,4'-phenyl-methylene-bis-(2-methyl phenol) were used as the bisphenol A, the addition amount of terephthalic acid chloride was 12.802 g, the addition amount of isophthalic acid chloride was 13.619 g, and 0.963 g of sebacic acid chloride were added instead of adipic acid chloride. The polystyrene average molecular weight Mw of the obtained copolymer polyarylate resin (III-22) (25.4 g, yield 53.4%) was 72,000. The structural formula of the copolymer polyarylate resin (III-22) was as follows.

(III-22)

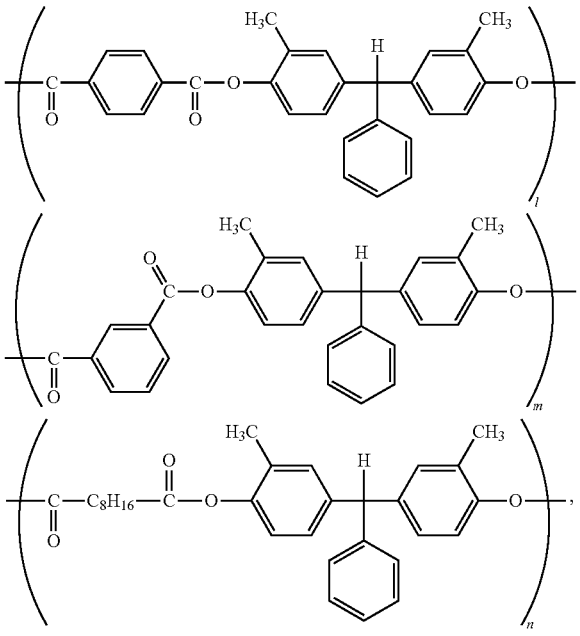

where l:m:n=47:50:3 (molar ratio).

Manufacturing Example 23

Method for Manufacturing a Copolymer Polyarylate Resin (III-23)

The example was identical to Manufacturing example 1, except that herein the addition amount of terephthalic acid chloride was 12.802 g, the addition amount of isophthalic acid chloride was 13.619 g, and 1.075 g of dodecanedioic acid chloride were added instead of adipic acid chloride. The polystyrene average molecular weight Mw of the obtained copolymer polyarylate resin (III-23) (24.0 g, yield 49.5%) was 73,000. The structural formula of the copolymer polyarylate resin (III-23) was as follows.

(III-23)

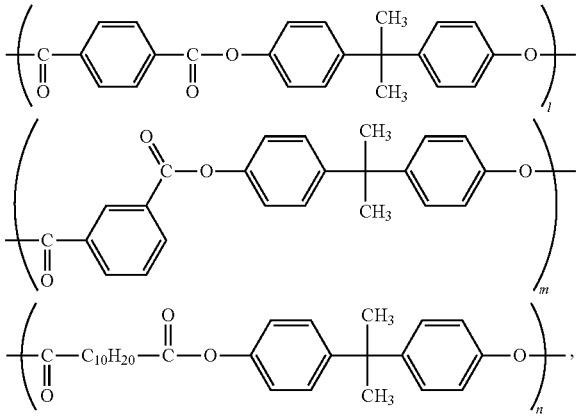

where l:m:n=47:50:3 (molar ratio).

Manufacturing Example 24

Method for Manufacturing a Copolymer Polyarylate Resin (III-24)

The example was identical to Manufacturing example 1, except that herein 38.6 g of 4,4'-methyl-phenyl-methylene-bis-(2-methyl phenol) were used as the bisphenol A, the addition amount of terephthalic acid chloride was 12.802 g, the addition amount of isophthalic acid chloride was 13.619 g, and 1.075 g of dodecanedioic acid chloride were added instead of adipic acid chloride. The polystyrene average molecular weight Mw of the obtained copolymer polyarylate resin (III-24) (29 g, yield 61.0%) was 70,500. The structural formula of the copolymer polyarylate resin (III-24) was as follows.

(III-24)

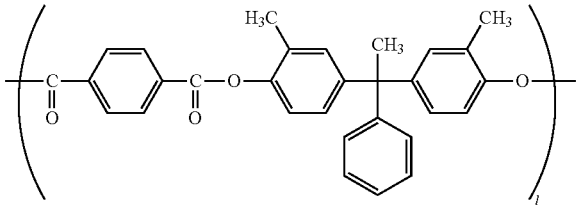

-continued

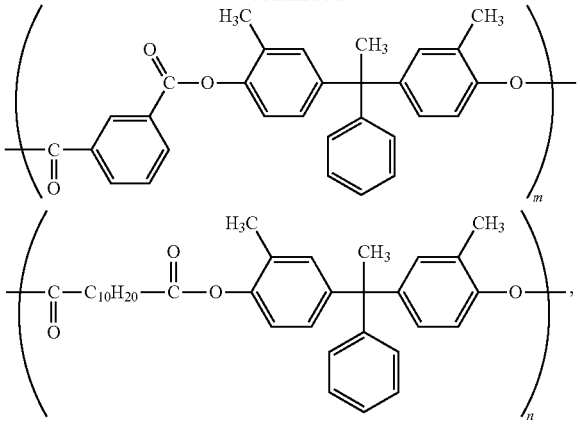

where l:m:n=47:50:3 (molar ratio).

Manufacturing Example 25

Method for Manufacturing a Copolymer Polyarylate Resin (III-25)

The example was identical to Manufacturing example 1, except that herein the addition amount of terephthalic acid chloride was 7.354 g, the addition amount of isophthalic acid chloride was 19.066 g, and 0.850 g of suberic acid chloride were added instead of adipic acid chloride. The weight-average molecular weight Mw, in terms of polystyrene equivalent, of the obtained copolymer polyarylate resin (III-25) (23.4 g, yield 48.9%), was 72,800. The structural formula of the copolymer polyarylate resin (III-25) was as follows.

(III-25)

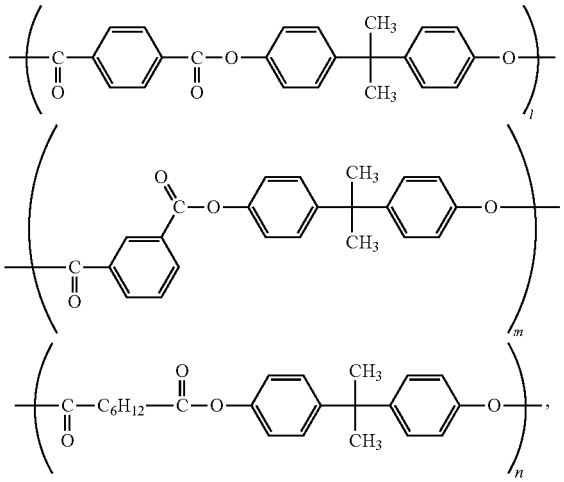

where l:m:n=27:70:3 (molar ratio).

Manufacturing Example 26

Method for Manufacturing a Copolymer Polyarylate Resin (III-26)

The example was identical to Manufacturing example 1, except that herein the addition amount of terephthalic acid chloride was 13.483 g, the addition amount of isophthalic acid chloride was 13.619 g, and 0.142 g of suberic acid chloride were added instead of adipic acid chloride. The weight-average molecular weight Mw, in terms of polystyrene equivalent, of the obtained copolymer polyarylate resin (III-26) (23.3 g, yield 48.7%), was 71,000. The structural formula of the copolymer polyarylate resin (III-26) was as follows.

(III-26)

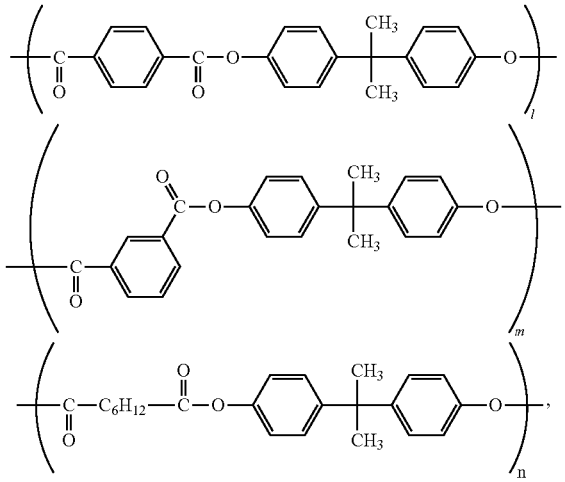

where l:m:n=49.5:50:0.5 (molar ratio).

Manufacturing Example 27

Method for Manufacturing a Copolymer Polyarylate Resin (III-27)

The example was identical to Manufacturing example 1, except that herein the addition amount of terephthalic acid chloride was 7.354 g, the addition amount of isophthalic acid chloride was 19.066 g, and 0.963 g of sebacic acid chloride were added instead of adipic acid chloride. The weight-average molecular weight Mw, in terms of polystyrene equivalent, of the obtained copolymer polyarylate resin (III-27) (23.5 g, yield 49.0%), was 69,000. The structural formula of the copolymer polyarylate resin (III-27) was as follows.

(III-27)

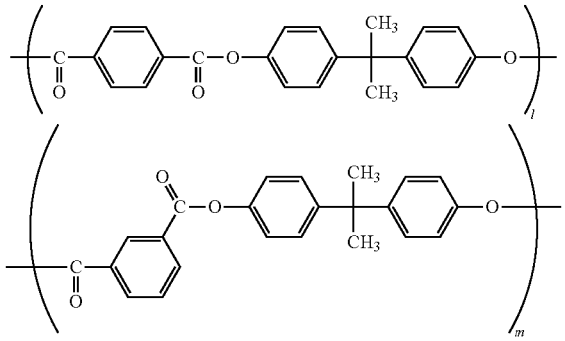

-continued

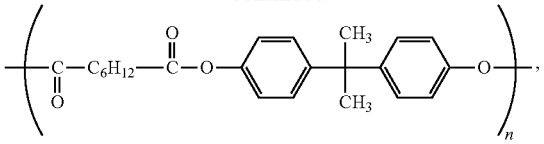

where l:m:n=27:70:3 (molar ratio).

Manufacturing Example 28

Method for Manufacturing a Copolymer Polyarylate Resin (III-28)

The example was identical to Manufacturing example 1, except that herein the addition amount of terephthalic acid chloride was 13.483 g, the addition amount of isophthalic acid chloride was 13.619 g, and 0.160 g of sebacic acid chloride were added instead of adipic acid chloride. The weight-average molecular weight Mw, in terms of polystyrene equivalent, of the obtained copolymer polyarylate resin (III-28) (22.8 g, yield 47.6%), was 68,100. The structural formula of the copolymer polyarylate resin (III-28) was as follows.

(III-28)

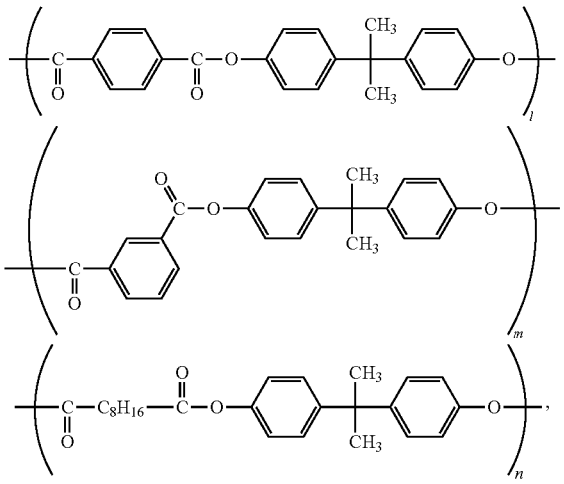

where l:m:n=49.5:50:0.5 (molar ratio).

Manufacturing Example 29

Method for Manufacturing a Copolymer Polyarylate Resin (III-29)

The example was identical to Manufacturing example 1, except that herein the addition amount of terephthalic acid chloride was 7.354 g, the addition amount of isophthalic acid chloride was 19.066 g, and 1.075 g of dodecanedioic acid chloride were added instead of adipic acid chloride. The weight-average molecular weight Mw, in terms of polystyrene equivalent, of the obtained copolymer polyarylate resin (III-29) (24.2 g, yield 50.3%), was 72,300. The structural formula of the copolymer polyarylate resin (III-29) was as follows.

(III-29)

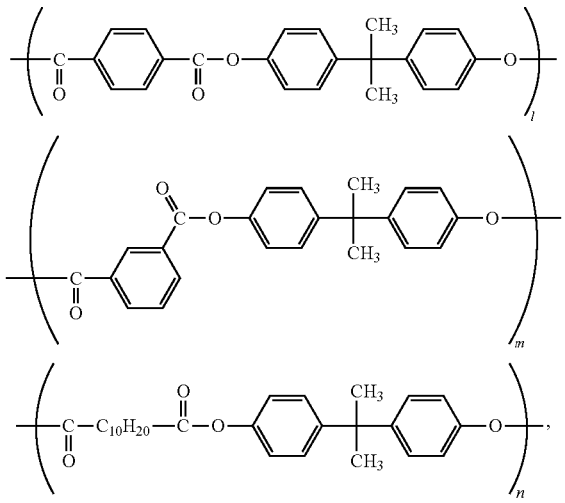

where l:m:n=27:70:3 (molar ratio).

Manufacturing Example 30

Method for Manufacturing a Copolymer Polyarylate Resin (III-30)

The example was identical to Manufacturing example 1, except that herein the addition amount of terephthalic acid chloride was 13.483 g, the addition amount of isophthalic acid chloride was 13.619 g, and 0.179 g of dodecanedioic acid chloride were added instead of adipic acid chloride. The weight-average molecular weight Mw, in terms of polystyrene equivalent, of the obtained copolymer polyarylate resin (III-30) (23.9 g, yield 49.9%), was 72,200. The structural formula of the copolymer polyarylate resin (III-30) was as follows.

(III-30)

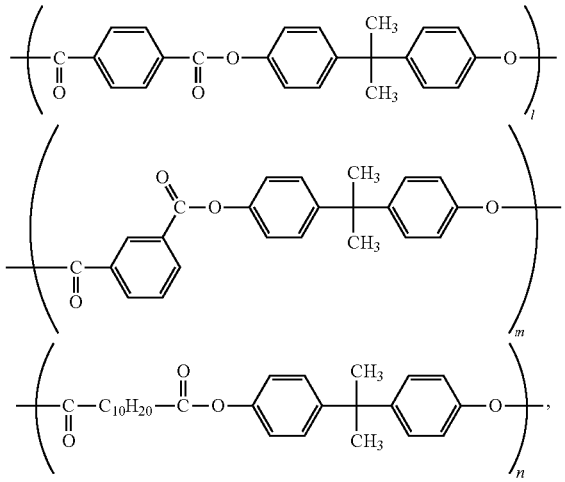

where l:m:n=49.5:50:0.5 (molar ratio).

Manufacturing Example 31

Method for Manufacturing a Copolymer Polyarylate Resin (III-31)

The example was identical to Manufacturing example 1, except that herein the addition amount of terephthalic acid chloride was 13.619 g, the addition amount of isophthalic acid chloride was 13.619 g, and no adipic acid chloride was added. The weight-average molecular weight Mw, in terms of polystyrene equivalent, of the obtained copolymer polyarylate resin (III-31) (24.0 g, yield 50.2%), was 72,700. The structural formula of the copolymer polyarylate resin (III-31) was as follows.

(III-31)

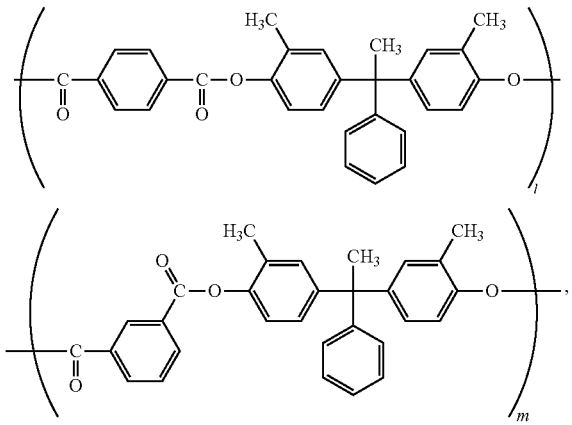

where l:m=50:50 (molar ratio).

Manufacturing Example 32

Method for Manufacturing a Copolymer Polyarylate Resin (III-32)

The example was identical to Manufacturing example 1, except that herein the addition amount of terephthalic acid chloride was 8.171 g, the addition amount of isophthalic acid chloride was 19.066 g, and no adipic acid chloride was added. The weight-average molecular weight Mw, in terms of polystyrene equivalent, of the obtained copolymer polyarylate resin (III-32) (24.0 g, yield 50.2%), was 74,200. The structural formula of the copolymer polyarylate resin (III-32) was as follows.

(III-32)

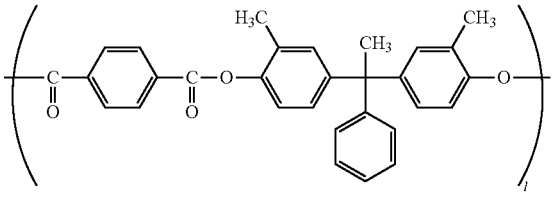

-continued

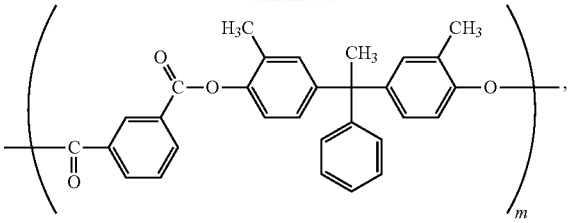

where l:m=30:70 (molar ratio).

Photoconductor Manufacture

Example 1

The outer periphery of an aluminum tube, as the conductive substrate 1, was dip-coated in a coating solution that was prepared by dissolving and dispersing, as an undercoat layer, 5 parts by weight of an alcohol-soluble nylon (product name "CM8000", by Toray) and 5 parts by weight of aminosilane-treated titanium oxide microparticles in 90 parts by weight of methanol, followed by drying for 30 minutes at a temperature of 100° C., to form a 3 μm-thick undercoat layer 2.

On the undercoat layer 2 there was formed a 0.3 μm-thick charge generation layer 4, by dip coating using a coating solution prepared by dissolving and dispersing 1 part by weight a metal-free phthalocyanine represented by the formula below,

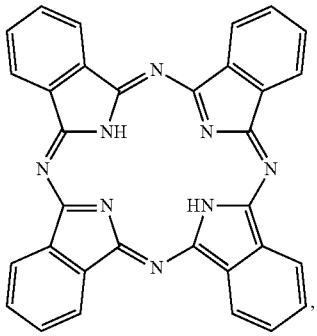

as the charge generation material, and 1.5 parts by weight of a polyvinyl butyral resin ("Slec KS-1", by Sekisui Chemical), as the resin binder, in 60 parts by weight of dichloromethane, followed by drying for 30 minutes at a temperature of 80° C.

On the charge generation layer 4 there was formed a 25-μm thick charge transport layer 5, by dip coating of a coating solution prepared by dissolving and dispersing 90 parts by weight of a stilbene compound represented by the formula below,

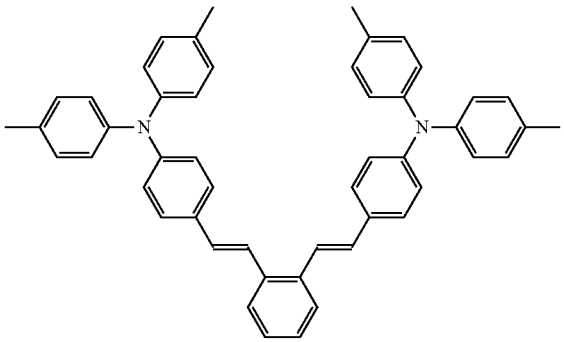

as a charge transport material, and 110 parts by weight of the copolymer polyarylate resin (III-1) of Manufacturing example 1, as the resin binder, in 1000 parts by weight of dichloromethane, followed by drying for 60 minutes at a temperature of 90° C., to prepare an organic electrophotographic photoconductor.

Example 2

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-2) manufactured in Manufacturing example 2.

Example 3

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-3) manufactured in Manufacturing example 3.

Example 4

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-4) manufactured in Manufacturing example 4.

Example 5

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-5) manufactured in Manufacturing example 5.

Example 6

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-6) manufactured in Manufacturing example 6.

Example 7

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-7) manufactured in Manufacturing example 7.

Comparative Example 1

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-8) manufactured in Manufacturing example 8.

Comparative Example 2

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-9) manufactured in Manufacturing example 9.

Comparative Example 3

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-10) manufactured in Manufacturing example 10.

Comparative Example 4

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-11) manufactured in Manufacturing example 11.

Comparative Example 5

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-12) manufactured in Manufacturing example 12.

Comparative Example 6

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-13) manufactured in Manufacturing example 13.

Comparative Example 7

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-14) manufactured in Manufacturing example 14.

Comparative Example 8

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-15) manufactured in Manufacturing example 15.

Comparative Example 9

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-16) manufactured in Manufacturing example 16.

Comparative Example 10

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-17) manufactured in Manufacturing example 17.

Comparative Example 11

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-18) manufactured in Manufacturing example 18.

Example 8

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-19) manufactured in Manufacturing example 19.

Example 9

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-20) manufactured in Manufacturing example 20.

Example 10

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-21) manufactured in Manufacturing example 21.

Example 11

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-22) manufactured in Manufacturing example 22.

Example 12

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-23) manufactured in Manufacturing example 23.

Example 13

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-24) manufactured in Manufacturing example 24.

Comparative Example 12

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-25) manufactured in Manufacturing example 25.

Comparative Example 13

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-26) manufactured in Manufacturing example 26.

Comparative Example 14

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-27) manufactured in Manufacturing example 27.

Comparative Example 15

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-28) manufactured in Manufacturing example 28.

Comparative Example 16

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-29) manufactured in Manufacturing example 29.

Comparative Example 17

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-30) manufactured in Manufacturing example 30.

Comparative Example 18

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-31) manufactured in Manufacturing example 31.

Comparative Example 19

An organic electrophotographic photoconductor was manufactured in accordance with the same method as in Example 1, but replacing herein the copolymer polyarylate resin (III-1) of Manufacturing example 1, used in Example 1, by the copolymer polyarylate resin (III-32) manufactured in Manufacturing example 32.

Example 14

The outer periphery of an aluminum tube, as the conductive substrate 1, was dip-coated in a coating solution that was prepared by dissolving and stirring, as an undercoat layer, 5 parts by weight of a vinyl chloride-vinyl acetate-vinyl alcohol copolymer (product name "SOLBIN-A" by Nissin Chemical Industry CO., Ltd.) in 95 parts by weight of methyl ethyl ketone, followed by drying for 30 minutes at a temperature of 100° C., to form a 0.2 μm-thick undercoat layer 2.

On the undercoat layer 2 there was dip-coated a coating solution prepared by dissolving and dispersing 2 parts by weight of a metal-free phthalocyanine represented by the formula below, as a charge generation material,

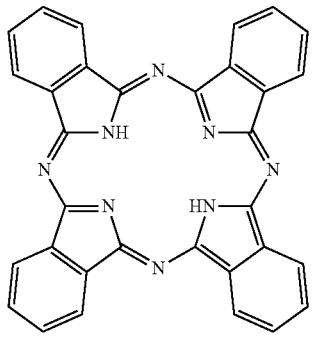

65 parts by weight of a stilbene compound represented by the formula below, as a hole transport material,

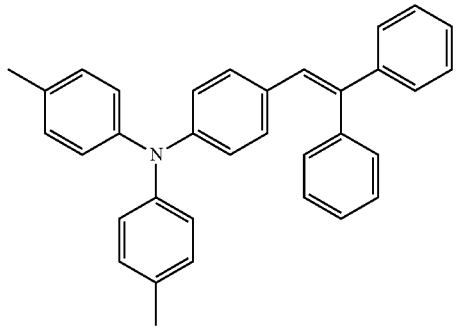

28 parts by weight of a compound represented by the formula below as an electron transport material, and

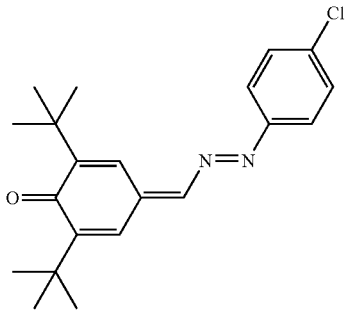

105 parts by weight of the copolymer polyarylate resin (III-1) of Manufacturing example 1, as the resin binder, in 1000 parts by weight of dichloromethane, followed by drying for 60 minutes at a temperature of 100° C., to yield a 25 μm-thick photosensitive layer, and manufacture thereby an organic electrophotographic photoconductor.

Comparative Example 20

An organic electrophotographic photoconductor was manufactured in accordance with the same method as in Example 9, but replacing herein the copolymer polyarylate resin (III-1) of Manufacturing example 1, used in Example 8, by the copolymer polyarylate resin (III-8) manufactured in Manufacturing example 8.

Photoconductor Evaluation:

The solvent cracking resistance, lubricity and electric characteristics of the photoconductors manufactured in Examples 1 to 14 and Comparative examples 1 to 20 were evaluated in accordance with the methods below. Solubility towards the solvent of the copolymer polyarylate resin was also evaluated upon preparation of the coating solution for charge transport layers, to evaluate the coating solution state.

Solvent Cracking Resistance Test:

Under an environment of 25° C./50%, about 2 mL of deox cream (by Laser Land Inc. USA) were divided into 7 equal parts that were then uniformly applied, using a dropper, to 7 sites on the surface of a photosensitive drum of the each photoconductor, and the photosensitive drum was then left to stand. The respective sites were then wiped off with a clean cloth after 5 minutes, 10 minutes, 15 minutes, 30 minutes, 60 minutes, 90 minutes and 120 minutes. The presence or absence of cracks on the surface coated with the cream was assessed. The results were expressed as the shortest time at which cracks are detected. Absence of cracks after 120 minutes was rated as "≧120 minutes". The obtained results are summarized in Tables 3 and 4.

Lubricity Evaluation:

The lubricity of a photosensitive drum surface manufactured in the examples and comparative examples was measured using a Heidon surface property tester. A urethane rubber blade was pressed against the drum surface at a constant load (20 g), and the blade was moved along the longitudinal direction of the drum. The load derived from the resulting friction was measured as the frictional force. A polyethylene film, which was used as a reference sample, was fixed to a tube having the same shape as the measurement sample, in such a manner that the film did not move. The polyethylene film was then measured in exactly the same way as in the case of a test sample.

The coefficient of friction was calculated on the basis of the frictional forces on the test sample and the film, in accordance with the formula below.

(Coefficient of friction)=(frictional force of test sample)/(frictional force of reference sample (film)).

The common parameters employed in the measurements were as follows:

Tester: Heidon surface property tester, model 14-D;
Rubber hardness;
Rubber contact angle;
Rubber displacement width 50 mm;
Rubber displacement speed 10 mm/sec;
Contact load 50 g; and
Reference sample polyethylene film (25 μm thick).

Electric Characteristics:

The surface of the photoconductor in the stacked photoconductors of Examples 1 to 13 and Comparative examples 1 to 19 was firstly charged to −650 V by corona discharge in the dark, and then the surface potential $V_0$ immediately after charging was measured.

The surface potential $V_5$ was measured 5 seconds after being left to stand in the dark, to determine the potential retention rate $Vk_5$(%) after 5 seconds since charging, in accordance with formula (1) below:

$$Vk_5=V_5/V_0\times 100 \quad (1).$$

Next there was determined the exposure amount $E_{1/2}$ necessary for optical attenuation until the surface potential reaches −300 V, and the exposure amount $E_{50}$ ($\mu Jcm^{-2}$) necessary for optical attenuation until the surface potential reaches −50 V, through irradiation of the photoconductor over 5 seconds under exposure light filtered to 780 nm by way of a filter and using a halogen lamp as a light source, starting from the point in time at which the surface potential is −600 V.

The surface of the photoconductor in the stacked photoconductors of Example 14 and Comparative example 20 was firstly charged to +650 V by corona discharge in the dark, and then the surface potential $V_0$ immediately after charging was measured.

The surface potential $V_5$ was measured 5 seconds after being left to stand in the dark, to determine the potential retention rate $Vk_5$(%) after 5 seconds since charging, in accordance with formula (1) above.

Next there was determined the exposure amount $E_{1/2}$ necessary for optical attenuation until the surface potential reaches +300 V, and the exposure amount $E_{50}$ ($\mu Jcm^{-2}$) necessary for optical attenuation until the surface potential reaches +50 V, through irradiation of the photoconductor over 5 seconds under exposure light filtered to 780 nm by way of a filter and using a halogen lamp as a light source, starting from the point in time at which the surface potential is +600 V The photoconductors manufactured in Examples 1 to 13 and Comparative examples 1 to 19 were installed in a printer of non-magnetic one-component development type having a negatively-chargeable contact charging mechanism, modified so as to allow measuring the surface potential of the photoconductor. The electric characteristics of the printer were evaluated.

The photoconductors manufactured in Example 14 and Comparative example 20 were installed in a printer of non-magnetic one-component development type having a negatively-chargeable contact charging mechanism, modified so as to allow measuring the surface potential of the photoconductor. The electric characteristics of the printer were evaluated.

The particulars of Examples 1 to 14 and Comparative examples 1 to 20, as well as the various evaluation results obtained, are summarized in Tables 1 to 4.

TABLE 1

| | | Resin | l | m | n | Alkyl component |
|---|---|---|---|---|---|---|
| Mfg. example 1 | Example 1 | (III-1) | 34 | 65 | 1 | Adipic acid |
| Mfg. example 2 | Example 2 | (III-2) | 49 | 50 | 1 | Adipic acid |
| Mfg. example 3 | Example 3 | (III-3) | 47 | 50 | 3 | Adipic acid |
| Mfg. example 4 | Example 4 | (III-4) | 44 | 50 | 6 | Adipic acid |
| Mfg. example 5 | Example 5 | (III-5) | 40 | 50 | 10 | Adipic acid |
| Mfg. example 6 | Example 6 | (III-6) | 47 | 50 | 3 | Adipic acid |
| Mfg. example 7 | Example 7 | (III-7) | 47 | 50 | 3 | Adipic acid |
| Mfg. example 8 | Comp. example 1 | (III-8) | 24 | 75 | 1 | Adipic acid |
| Mfg. example 9 | Comp. example 2 | (III-9) | 29 | 70 | 1 | Adipic acid |
| Mfg. example 10 | Comp. example 3 | (III-10) | 59 | 40 | 1 | Adipic acid |
| Mfg. example 11 | Comp. example 4 | (III-11) | 69 | 30 | 1 | Adipic acid |
| Mfg. example 12 | Comp. example 5 | (III-12) | 49.5 | 50 | 0.5 | Adipic acid |
| Mfg. example 13 | Comp. example 6 | (III-13) | 39 | 50 | 11 | Adipic acid |
| Mfg. example 14 | Comp. example 7 | (III-14) | 35 | 50 | 15 | Adipic acid |
| Mfg. example 15 | Comp. example 8 | (III-15) | 29.5 | 70 | 0.5 | Adipic acid |
| Mfg. example 16 | Comp. example 9 | (III-16) | 49.5 | 50 | 0.5 | Adipic acid |
| Mfg. example 17 | Comp. example 10 | (III-17) | 19 | 70 | 11 | Adipic acid |

TABLE 2

| | | Resin | l | m | n | Alkyl component |
|---|---|---|---|---|---|---|
| Mfg. example 18 | Comp. example 11 | (III-18) | 49 | 40 | 11 | Adipic acid |
| Mfg. example 19 | Example 8 | (III-19) | 47 | 50 | 3 | Suberic acid |
| Mfg. example 20 | Example 9 | (III-20) | 47 | 50 | 3 | Suberic acid |
| Mfg. example 21 | Example 10 | (III-21) | 47 | 50 | 3 | Sebacic acid |
| Mfg. example 22 | Example 11 | (III-22) | 47 | 50 | 3 | Sebacic acid |
| Mfg. example 23 | Example 12 | (III-23) | 47 | 50 | 3 | Dodecanedioic acid |
| Mfg. example 24 | Example 13 | (III-24) | 47 | 50 | 3 | Dodecanedioic acid |
| Mfg. example 25 | Comp. example 12 | (III-25) | 27 | 70 | 3 | Suberic acid |
| Mfg. example 26 | Comp. example 13 | (III-26) | 49.5 | 50 | 0.5 | Suberic acid |
| Mfg. example 27 | Comp. example 14 | (III-27) | 27 | 70 | 3 | Sebacic acid |
| Mfg. example 28 | Comp. example 15 | (III-28) | 49.5 | 50 | 0.5 | Sebacic acid |
| Mfg. example 29 | Comp. example 16 | (III-29) | 27 | 70 | 3 | Dodecanedioic acid |

TABLE 2-continued

| | | Resin | l | m | n | Alkyl component |
|---|---|---|---|---|---|---|
| Mfg. example 30 | Comp. example 17 | (III-30) | 49.5 | 50 | 0.5 | Dodecanedioic acid |
| Mfg. example 31 | Comp. example 18 | (III-31) | 50 | 50 | 0 | — |
| Mfg. example 32 | Comp. example 19 | (III-32) | 30 | 70 | 0 | — |
| Mfg. example 1 | Example 14 | (III-1) | 34 | 65 | 1 | Adipic acid |
| Mfg. example 8 | Comp. example 20 | (III-8) | 54 | 45 | 1 | Adipic acid |

TABLE 3

| | Solubility | Cracks | Lubricity | Charge | $Vk_5$ (%) | $E_{1/2}$ ($\mu j/cm^{-2}$) | $E_{50}$ ($\mu j/cm^{-2}$) | Potential at printer | Overall assessment |
|---|---|---|---|---|---|---|---|---|---|
| Example 1 | Soluble | ≧120 min | 1.33 | Negative | 95 | 0.34 | 2.00 | 107 | Good |
| Example 2 | Soluble | ≧120 min | 1.35 | Negative | 95 | 0.35 | 2.15 | 115 | Good |
| Example 3 | Soluble | ≧120 min | 1.4 | Negative | 95 | 0.35 | 2.22 | 119 | Good |
| Example 4 | Soluble | ≧120 min | 1.38 | Negative | 95 | 0.34 | 1.98 | 108 | Good |
| Example 5 | Soluble | ≧120 min | 1.32 | Negative | 95 | 0.35 | 2.03 | 109 | Good |
| Example 6 | Soluble | ≧120 min | 1.41 | Negative | 95 | 0.34 | 2.11 | 112 | Good |
| Example 7 | Soluble | ≧120 min | 1.4 | Negative | 95 | 0.34 | 1.95 | 104 | Good |
| Comp. example 1 | Partial residue | 15 min | 1.37 | Negative | 88 | 0.35 | 4.34 | 254 | Deficient |
| Comp. example 2 | Soluble | 30 min | 1.32 | Negative | 95 | 0.34 | 1.99 | 108 | Deficient |
| Comp. example 3 | Soluble | 30 min | 1.29 | Negative | 95 | 0.35 | 2.04 | 109 | Deficient |
| Comp. example 4 | Soluble | 15 min | 1.31 | Negative | 95 | 0.35 | 2.00 | 107 | Deficient |
| Comp. example 5 | Soluble | 30 min | 2.24 | Negative | 95 | 0.34 | 1.95 | 104 | Deficient |
| Comp. example 6 | Soluble | 30 min | 2.22 | Negative | 95 | 0.35 | 2.08 | 109 | Deficient |
| Comp. example 7 | Soluble | 30 min | 2.25 | Negative | 95 | 0.35 | 2.09 | 112 | Deficient |
| Comp. example 8 | Soluble | 30 min | 2.25 | Negative | 95 | 0.34 | 1.93 | 103 | Deficient |
| Comp. example 9 | Soluble | 30 min | 2.11 | Negative | 95 | 0.35 | 2.09 | 114 | Deficient |
| Comp. example 10 | Soluble | 30 min | 2.21 | Negative | 95 | 0.35 | 2.00 | 107 | Deficient |

TABLE 4

| | Solubility | Cracks | Lubricity | Charge | $Vk_5$ (%) | $E_{1/2}$ ($\mu j/cm^{-2}$) | $E_{50}$ ($\mu j/cm^{-2}$) | Potential at printer | Overall assessment |
|---|---|---|---|---|---|---|---|---|---|
| Comp. example 11 | Soluble | 30 min | 2.00 | Negative | 95 | 0.34 | 1.88 | 101 | Deficient |
| Example 8 | Soluble | ≧120 min | 1.25 | Negative | 95 | 0.34 | 1.85 | 101 | Good |
| Example 9 | Soluble | ≧120 min | 1.39 | Negative | 95 | 0.34 | 1.99 | 107 | Good |
| Example 10 | Soluble | ≧120 min | 1.18 | Negative | 95 | 0.35 | 2.03 | 109 | Good |
| Example 11 | Soluble | ≧120 min | 1.41 | Negative | 95 | 0.35 | 2.00 | 105 | Good |
| Example 12 | Soluble | ≧120 min | 1.07 | Negative | 95 | 0.36 | 2.20 | 118 | Good |
| Example 13 | Soluble | ≧120 min | 1.41 | Negative | 95 | 0.34 | 2.01 | 109 | Good |
| Comp. example 12 | Soluble | 30 min | 1.23 | Negative | 95 | 0.35 | 2.03 | 109 | Deficient |
| Comp. example 13 | Soluble | 30 min | 2.3 | Negative | 95 | 0.34 | 1.85 | 97 | Deficient |
| Comp. example 14 | Soluble | 30 min | 1.16 | Negative | 95 | 0.34 | 1.86 | 100 | Deficient |
| Comp. example 15 | Soluble | 30 min | 2.22 | Negative | 95 | 0.34 | 1.88 | 101 | Deficient |
| Comp. example 16 | Soluble | 30 min | 1.09 | Negative | 95 | 0.35 | 2.03 | 109 | Deficient |

TABLE 4-continued

| | Solubility | Cracks | Lubricity | Charge | $Vk_5$ (%) | $E_{1/2}$ ($\mu j/cm^{-2}$) | $E_{50}$ ($\mu j/cm^{-2}$) | Potential at printer | Overall assessment |
|---|---|---|---|---|---|---|---|---|---|
| Comp. example 17 | Soluble | 30 min | 2.19 | Negative | 95 | 0.35 | 2.09 | 112 | Deficient |
| Comp. example 18 | Soluble | ≧120 min | 2.26 | Negative | 94 | 0.36 | 2.00 | 107 | Deficient |
| Comp. example 19 | Soluble | 30 min | 2.29 | Negative | 94 | 0.36 | 2.00 | 107 | Deficient |
| Example 14 | Soluble | ≧120 min | 1.33 | Positive | 95 | 1.12 | 5.69 | 204 | Good |
| Comp. example 20 | Soluble | 15 min | 1.22 | Positive | 95 | 1.10 | 5.80 | 210 | Deficient |

The results of Tables 3 and 4 show that the photoconductors of Examples 1 to 14 exhibit good characteristics as regards solvent cracking resistance, without impairment of electric characteristics. Comparative example 1, by contrast, was problematic as regards solubility and exhibited impaired electric characteristics. Comparative examples 2 to 19 exhibited non-problematic electric characteristics and good lubricity, but were deficient in solvent cracking resistance. Comparative examples 5 to 11, 13, 15, 17 and 19 were problematic as regards both solvent cracking resistance and lubricity. The solvent cracking resistance of Comparative example 18 was good, but lubricity was problematic. Concerning the single layer-type photoconductors of Example 14 and Comparative example 20, the photoconductor of Example 14 exhibited good solubility, solvent cracking resistance, lubricity and electric characteristics. By contrast, solvent cracking resistance in Comparative example 20 was strikingly poor, a result similar to the case of a stacked negatively-chargeable photoconductor. Other than in Comparative example 1, no problems were observed as regards electric characteristics in any of the examples upon fitting of the photoconductor into a printer having a contact charging mechanism.

The above results indicate thus that using the copolymer polyarylate resin according to the present invention in a photosensitive layer affords an electrophotographic photoconductor having excellent solvent cracking resistance and lubricity, without impairment of electric characteristics.

The invention claimed is:

1. An electrophotographic photoconductor, comprising:

a conductive substrate; and a photosensitive layer provided on the conductive substrate and comprised of a charge generation material; a charge transport material; and a resin hinder comprising, a copolymer polyarylate resin represented by general formula (I) below (I)

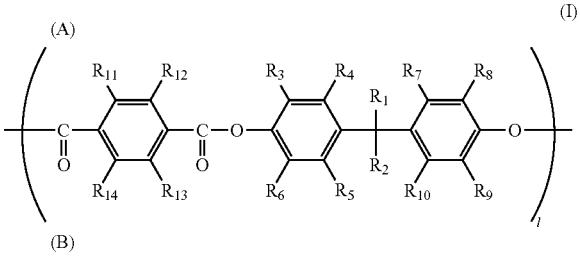

-continued

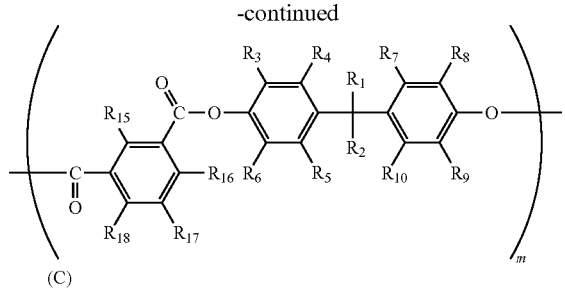

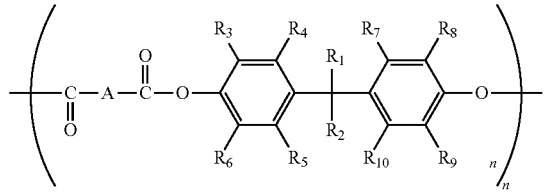

where partial structural formulas (A), (B) and (C) represent structural units that make up the resin binder; l, m and n represent respective mol % of the structural units (A), (B) and (C) such that l+m+n is 100 mol %, m is 50 to 65 mol % and n is 1 to 10 mol %; $R_1$ and $R_2$ may be identical or different and represent a hydrogen atom, a C1 to C8 alkyl group, a cycloalkyl group or an aryl group, or may form a cyclic structure together with a carbon atom to which these are bonded, and the cyclic structure may have bonded thereto 1 or 2 arylene groups; $R_3$ to $R_{18}$ may be identical or different and represent a hydrogen atom, a C1 to C8 alkyl group, a fluorine atom, a chlorine atom or a bromine atom; and A represents a C4 to C10 divalent alkylene group.

2. The electrophotographic photoconductor according to claim 1, wherein the photosensitive layer has a stacked type structure and includes at least one charge generation layer and at least one charge transport layer that are sequentially stacked, and wherein the charge transport layer comprises said charge transport material and said copolymer polyarylate resin represented by general formula (I).

3. The electrophotographic photoconductor according to claim 1, wherein the photosensitive layer has a stacked type structure and includes at least one charge transport layer and at least one charge generation layer that are sequentially stacked, and wherein the charge generation layer comprises said charge generation material and said copolymer polyarylate resin represented by general formula (I).

4. The electrophotographic photoconductor according to claim 1, wherein the photosensitive layer has a single layer-type structure.

5. The electrophotographic photoconductor according to claim 1, wherein $R_1$ and $R_2$ in the general formula (I) are both methyl groups, and $R_3$ to $R_{18}$ are hydrogen atoms.

6. The electrophotographic photoconductor according to claim 1, wherein the photosensitive layer has a surface that accepts charge when contacted by a charging mechanism for charging through contact with said surface of the photosensitive layer.

7. The electrophotographic photoconductor according to claim 1, wherein the electrophotographic photoconductor is charged and patternwise discharged in use to generate an image, and wherein the electrophotographic photoconductor is incorporated in an electrophotographic device that comprises a charging mechanism and a discharging mechanism, and optionally at least one of a mechanism for decreasing ozone or nitrogen oxides generated by the charging mechanism and a transfer mechanism.

8. The electrophotographic photoconductor according to claim 1, wherein the photosensitive layer of the electrophotographic photoconductor is charged and patternwise discharged in use to generate an image, and wherein the image is developed by a developing mechanism for performing development using a liquid developer.

9. A method for manufacturing an electrophotographic photoconductor, comprising the steps of:

providing a conductive substrate;

providing a coating solution that comprises a photoconductive material and a resin binder comprised of a copolymer polyarylate resin represented by general formula (I) below (I)

(A)

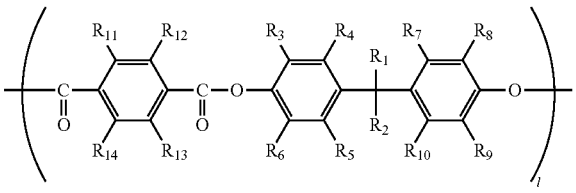

-continued (B)

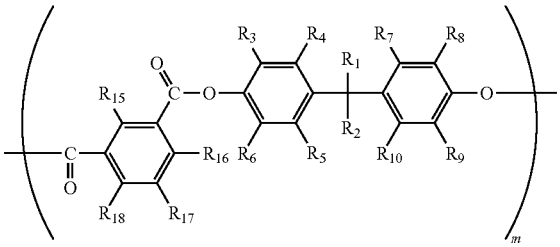

(C)

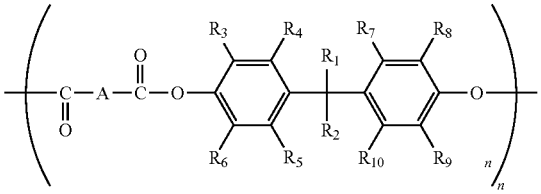

where partial structural formulas (A), (B) and (C) represent structural units that make up the resin binder; l, m and n represent the respective mol % of the structural units (A), (B) and (C) such that l+m+n is 100 mol %, m is 50 to 65 mol % and n is 1 to 10 mol %; $R_1$ and $R_2$ may be identical or different and represent a hydrogen atom, a C1 to C8 alkyl group, a cycloalkyl group or an aryl group, or may form a cyclic structure together with a carbon atom to which these are bonded, and the cyclic structure may have bonded thereto 1 or 2 arylene groups; $R_3$ to $R_{18}$ may be identical or different and represent a hydrogen atom, a C1 to C8 alkyl group, a fluorine atom, a chlorine atom or a bromine atom; and A represents a C4 to C10 divalent alkylene group; and coating the coating solution on the conductive substrate.

* * * * *